US007540043B2

(12) United States Patent
Stackley et al.

(10) Patent No.: US 7,540,043 B2
(45) Date of Patent: Jun. 2, 2009

(54) PORTABLE PATIENT CONVEYOR AND METHODS RELATED THERETO

(75) Inventors: Mark A. Stackley, St. Croix Falls, WI (US); Arthur G. Erdman, New Brighton, MN (US); Ryan Buesseler, Fergus Falls, MN (US); Shivakumar Hanubal, Leesburg, FL (US)

(73) Assignee: Regents of the University of Minnesota, St. Paul, MN (US)

( * ) Notice: Subject to any disclaimer, the term of this patent is extended or adjusted under 35 U.S.C. 154(b) by 262 days.

(21) Appl. No.: 11/293,884

(22) Filed: Dec. 2, 2005

(65) Prior Publication Data

US 2006/0225202 A1 Oct. 12, 2006

Related U.S. Application Data

(60) Provisional application No. 60/633,055, filed on Dec. 3, 2004.

(51) Int. Cl.
*A61G 1/003* (2006.01)

(52) U.S. Cl. ..... 5/81.1 C

(58) Field of Classification Search ..... 5/81.1 C, 5/81.1 HS, 81.1 R, 83.1; 198/300, 312, 318, 198/321

See application file for complete search history.

(56) References Cited

U.S. PATENT DOCUMENTS

RE28,056 E * 6/1974 Stevens ..... 5/81.1 C
4,967,427 A 11/1990 Cherepy, Sr.
5,096,045 A 3/1992 Feldl
5,390,379 A 2/1995 Palmer, Jr. et al.
5,737,781 A 4/1998 Votel
5,742,958 A 4/1998 Solazzo
5,860,174 A 1/1999 Failor
5,920,929 A 7/1999 Hensley et al.
5,933,884 A 8/1999 Shikinami et al.
5,937,456 A 8/1999 Norris
5,966,754 A 10/1999 Schuster
5,996,144 A 12/1999 Hodgetts
6,003,172 A 12/1999 Gonzalez et al.
6,012,183 A 1/2000 Brooke et al.

(Continued)

OTHER PUBLICATIONS

"Vision LLC Presents the Motorized Spine Board", *Vision LLC*, (2002), 2 pgs.

*Primary Examiner*—Michael Trettel
(74) *Attorney, Agent, or Firm*—Schwegman, Lundberg & Woessner P.A.

(57) ABSTRACT

This patent document discusses assemblies and methods for transferring a subject from a first surface to a second surface. In varying examples, an assembly includes a first roller and a second roller. An assembly frame rotatably supports the rollers and, in some examples, longitudinally extends from a frame first end to a frame second end. A belt is coupled to the first and second rollers in such a matter that the assembly frame is positioned, at least in part, between the rollers and surrounded by the belt. A motor, powered by a power source, is coupled to the belt via the first or second roller. In one such example, the motor is coupled with a portion of a first roller inner surface. In another example, an outer surface of one or both of the rollers include belt driving projections matable with projection receiving portions disposed on a belt underside surface.

39 Claims, 22 Drawing Sheets

U.S. PATENT DOCUMENTS

| | | | | |
|---|---|---|---|---|
| 6,131,214 | A | 10/2000 | Moenning et al. | |
| 6,131,215 | A | 10/2000 | Lindell | |
| 6,341,393 | B1 | 1/2002 | Votel | |
| 6,349,432 | B1 | 2/2002 | Scordato et al. | |
| 6,374,435 | B1 | 4/2002 | Leininger et al. | |
| 6,378,148 | B1 | 4/2002 | Votel | |
| 6,467,106 | B1 | 10/2002 | Heimbrock | |
| 6,484,332 | B2 | 11/2002 | Korver, II | |
| 6,496,991 | B1 | 12/2002 | Votel | |
| 6,507,963 | B2 | 1/2003 | Hodgetts | |
| 6,584,626 | B1 | 7/2003 | DiRoma | |
| 6,857,143 | B2 * | 2/2005 | McNulty | 5/81.1 C |
| 6,932,209 | B2 * | 8/2005 | Kasagami et al. | 198/312 |
| 6,945,387 | B1 | 9/2005 | Christensen | |
| 7,047,578 | B2 * | 5/2006 | Spanton | 5/81.1 R |
| 7,200,881 | B2 * | 4/2007 | Kasagami et al. | 5/81.1 R |

* cited by examiner

PORTABLE PATIENT CONVEYOR AND METHODS RELATED THERETO

CLAIM OF BENEFIT OF PRIOR-FILED APPLICATION

This patent application claims the benefit of U.S. Provisional Application Ser. No. 60/633,055, entitled "Portable Patient Conveyor," filed on Dec. 3, 2004, under 35 U.S.C. § 119(e), which is hereby incorporated by reference in its entirety.

TECHNICAL FIELD

This patent document pertains generally to the transfer of patients from a first support surface to a second support surface. More particularly, but not by way of limitation, this patent document pertains to a portable patient conveyor and methods related thereto.

BACKGROUND

Workers in hospitals, nursing homes, and private homes often face the challenge of moving a (partly or completely incapacitated) patient from one support surface (e.g., a bed, gurney, stretcher, examination or operating room table, etc.) to another such surface. The patient may need to be placed onto another support surface based on, among other things, a need for more comfort or to be brought to a desired area within a hospital. For instance, nurses or other hospital personnel (e.g., orderlies) may first physically move a patient from a hospital bed to a gurney, which is then relocated to a surgery or an examination room. When the gurney carrying the patient arrives at the desired area, the nurses or orderlies may again physically move the patient onto another bed or table.

Such manual patient transfer maneuver is both physically and psychologically demanding on the worker, not to mention the patient. The typical process involves a team of two or more caregivers first lifting and then sliding the patient's body sideways from the first surface to the next. Because the two support surfaces typically have to be positioned side-by-side, at least half the transfer team is in an awkward position at any given point during the transfer, having to help lift the patient while they are bending and reaching over one of the surfaces. This can be fairly hazardous, particularly if one of the support surfaces starts moving midstream. Large or obese patients are especially challenging, which is compounded by the fact that many caregivers tend to be petite in stature.

Because of the patient transfer demands, health care workers who have patient transfer duties are at high risk for back pain and injuries resulting in, among other things, lost time at work or worker compensation claims. It goes without saying that the patients are likewise at risk due to falls or the like when caregivers are inadequate to meet the physical and psychological demands of transferring the patient.

A survey of existing systems and methods suggests that there is no widely adopted safe, simple, and effective technique for transferring patients from one support surface to another. Rather, currently used systems and methods suffer from, among other things, one or more of the following drawbacks: being expensive to manufacture or implement (e.g., cannot be used with convention support surfaces), consisting of many complicated mechanical components, resulting in patient or worker discomfort through use, being too large for the limited space in hospital and assisted care rooms to be portable, or requiring a large amount of time or number of workers to effectuate the transfer.

As one example, a currently used system requires one or more workers to pull a patient across a device as the device supports the patient and rolls from one surface to another. In such a device, the patient's back is uncomfortably supported by a belt which passes over and around a number of rollers assembled within a device frame. As another example, a currently used system comprises a device that is too large to conveniently be used indoors (e.g., in a hospital setting). In addition, such device includes a belt having a rotation parallel to a length of the device thereby requiring a longer amount of time to effectuate a transfer of a subject from a first support surface to a second support surface.

It is with this recognition of the foregoing state of the technology that the present assemblies and methods directed to a portable patient conveyor have been conceived and are now set forth in text and drawings associated with this patent document.

BRIEF DESCRIPTION OF THE DRAWINGS

In the drawings, which are not necessarily drawn to scale, like numerals describe similar components throughout the several views. The drawings illustrate generally, by way of example, but not by way of limitation, various embodiments discussed in this patent document.

DETAILED DESCRIPTION

The following detailed description includes references to the accompanying drawings, which form a part of the detailed description. The drawings show, by way of illustration, specific embodiments in which the present assemblies and methods may be practiced. These embodiments, which are also referred to herein as "examples," are described in enough detail to enable those skilled in the art to practice the present assemblies and methods. The embodiments may be combined or varied, other embodiments may be utilized or structural, logical, or electrical changes may be made without departing from the scope of the present assemblies and methods (i.e., equivalent elements can be substituted for the elements employed in the present conveyor assembly to produce substantially the same results, in substantially the same way, to achieve substantially the same function). It is also to be understood that the various embodiments of the present assemblies and methods, although different, are not necessarily mutually exclusive. For example, a particular feature, structure or characteristic described in one embodiment may be included within other embodiments. The following detailed description is, therefore, not to be taken in a limiting sense and the scope of the present assemblies and methods are defined by the appended claims and their legal equivalents.

In this document the terms "a" or "an" are used to include one or more than one; the term "or" is used to refer to a nonexclusive or unless otherwise indicated; and the term "subject" is used to include the term "patient." In addition, it is to be understood that the phraseology or terminology employed herein, and not otherwise defined, is for the purpose of description only and not of limitation.

INTRODUCTION AND EXAMPLES

According to the Centers for Disease Control and Prevention (commonly referred to as "CDC"), injuries to health care workers' backs account for approximately 50% of workers compensation costs in the health care industry. Many of such back injuries are undoubtedly related to the challenge of moving subjects (i.e., patients) from one support surface to another. Advantageously, the present assemblies and methods provide a relatively safe, simple, and effective means to effectuate such transfer of subjects through the use of a motor-driven, portable conveyor controlled by, for example, the flip of a switch or touch of a button. The conveyor is configured to be used with conventional support surfaces and can easily be stored or transported as a result of its compact size. In addition, the present assemblies and methods require reduced involvement from attending health care workers (as compared to currently used assemblies and methods), can traverse uneven surfaces, and do not require lengthy worker training prior to use. Further advantages will also become apparent from a consideration of the ensuing description and associated drawings.

Figure 1:
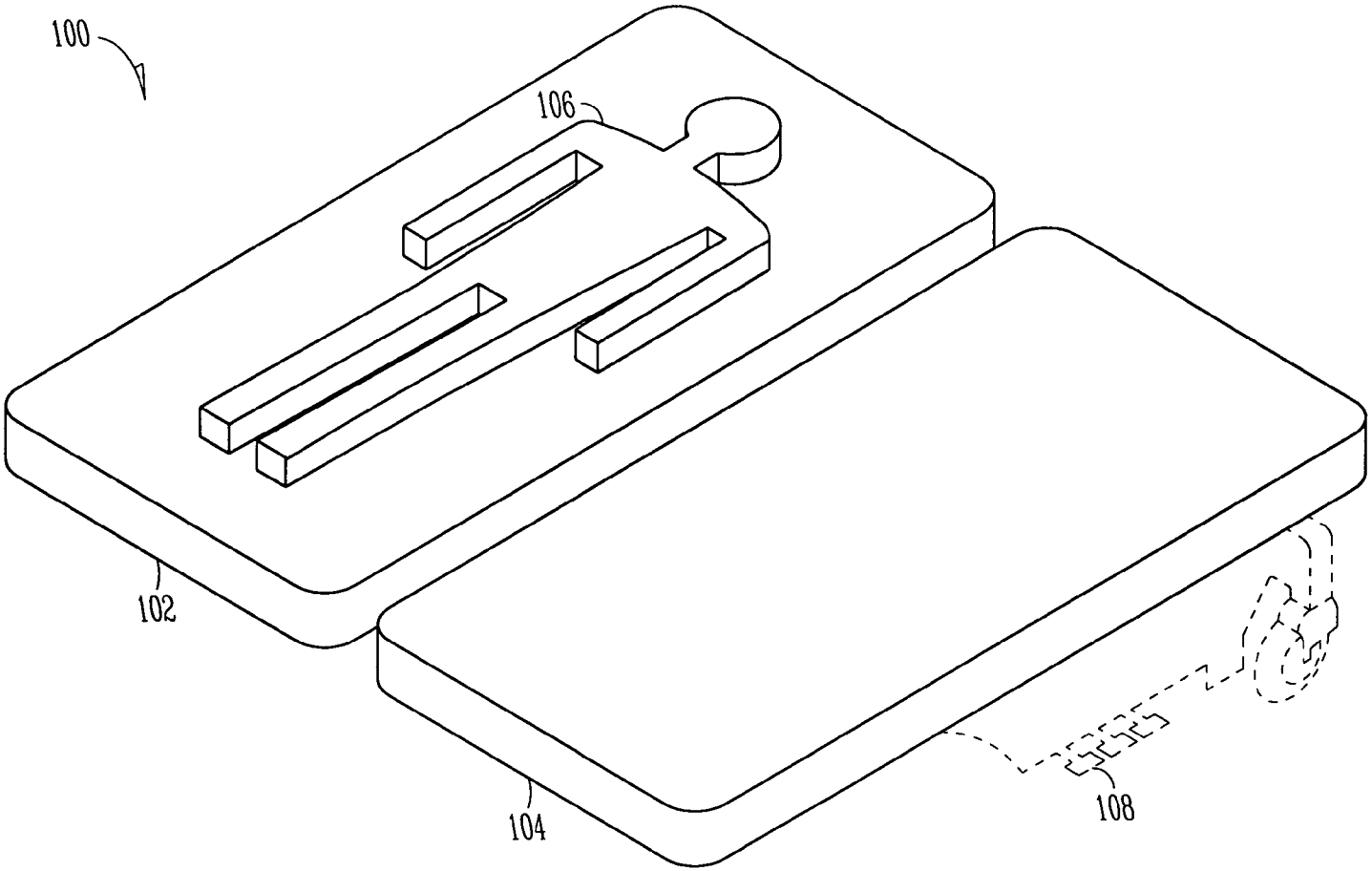
FIG. 1 is a schematic view illustrating a first support surface including a subject disposed thereon and a second support surface, as constructed in accordance with at least one embodiment.

FIG. 1 illustrates an environment 100 in which the portable conveyor assembly 202 (FIG. 2) according to the present invention may be used. As shown, environment 100 comprises a first support surface 102 and a second support surface 104. Second support surface 104 is positioned adjacent first support surface 102 to facilitate the transfer of a subject 106 between such surfaces. In this example, second support surface 104 includes wheel brakes 108 that can be engaged (e.g., by exerting a downward force on brakes 108) thereby locking the adjacent position of second support surface 104. Typically, but not necessary, first support surface 102 may also include wheel brakes or similar devices to lock a position thereof. Said support surfaces 102, 104 may include, among other things, a bed, a gurney, an examination table, an operating table, or any other useable or suitable surface that may be used by a subject 106 in the prone or nearly prone position.

FIGS. 2-9 pictorially illustrate a method 200 for transferring a subject 106 from a first horizontal support surface 102 to an adjacent second horizontal support surface 104 using a conveyor assembly 202 according to the present invention. Conveyor assembly 202 is provided to facilitate the transfer of subject 106 from first support surface 102 to second support surface 104 and is designed to effectuate such transfer in a manner that is safe for both subject 106 and an attending worker 204. The conveyor assembly 202 is designed for use with conventional support surfaces, regardless of manufacturer.

Figure 2:
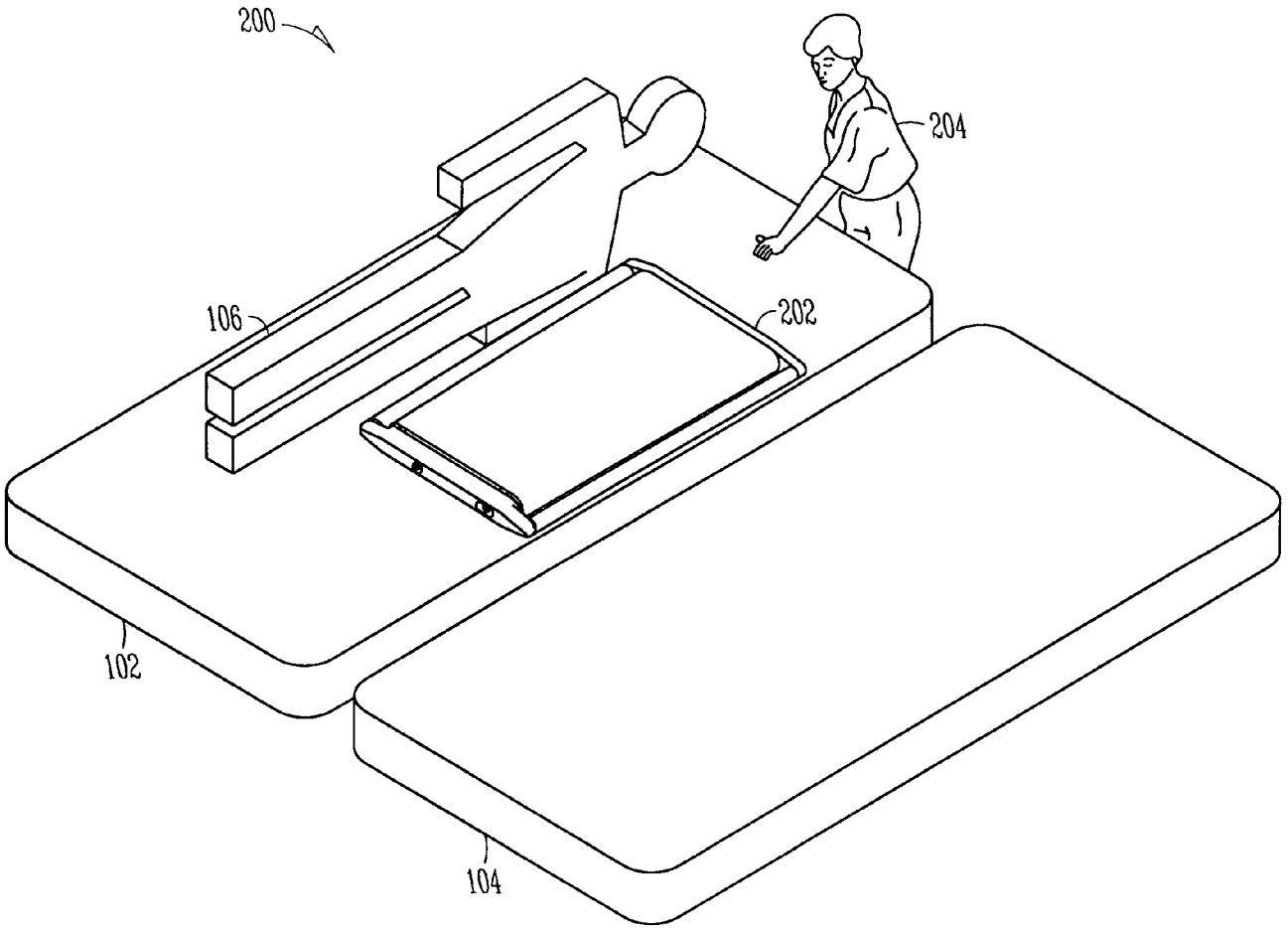
FIGS. 2-9 are schematic views pictorially illustrating a method of transferring a subject from a first support surface to a second support surface, as constructed in accordance with at least one embodiment.

Referring to FIG. 2, a second support surface 104 is shown positioned adjacent first support surface 102 as close together as possible so conveyor assembly 202 can span or traverse a gap, if any, therebetween. Subject 106 is shown (log) rolled onto his/her side such that the subject is facing away from the surface he/she is to be transferred to (i.e., second support surface 104). While subject 106 is on his/her side, attendant 204 places conveyor assembly 202 next to, and in some cases slightly touching (i.e., up against), subject 106. Conveyor assembly 202 is positioned relative to subject 106 so as to substantially support the subject's 106 shoulders and torso when subject 106 is rolled onto assembly 202 (see FIG. 3).

Figure 3:
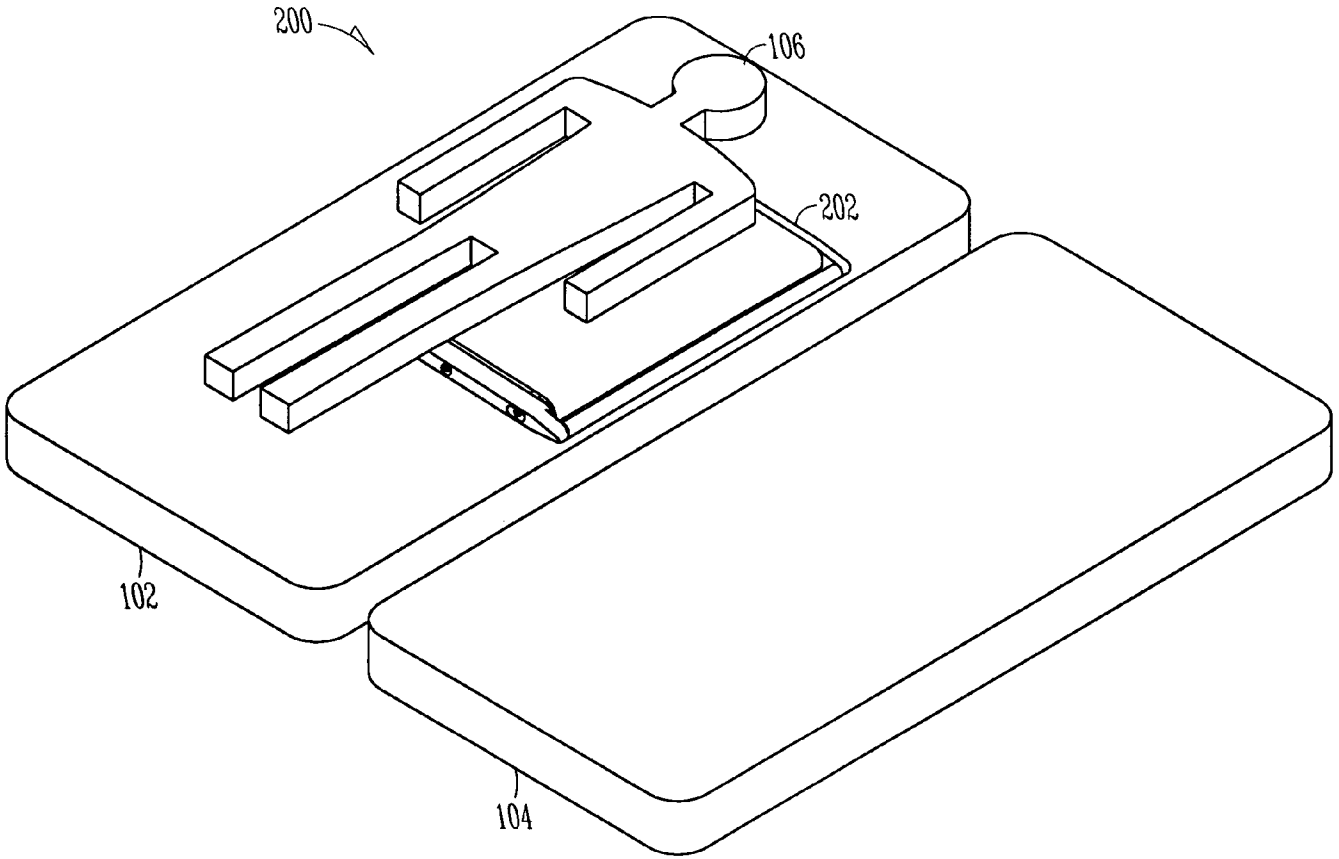

In FIG. 3, subject 106 is (log) rolled over onto conveyor assembly 202 such that a large portion of his/her weight is supported by assembly 202. In one example, subject 106 is rolled over by attendant 204 who placed conveyor assembly 202 next to subject 106. In another example, a second attendant rolls subject 106 on his/her side prior, and subsequent, to the placement of conveyor assembly 202.

Figure 4A:
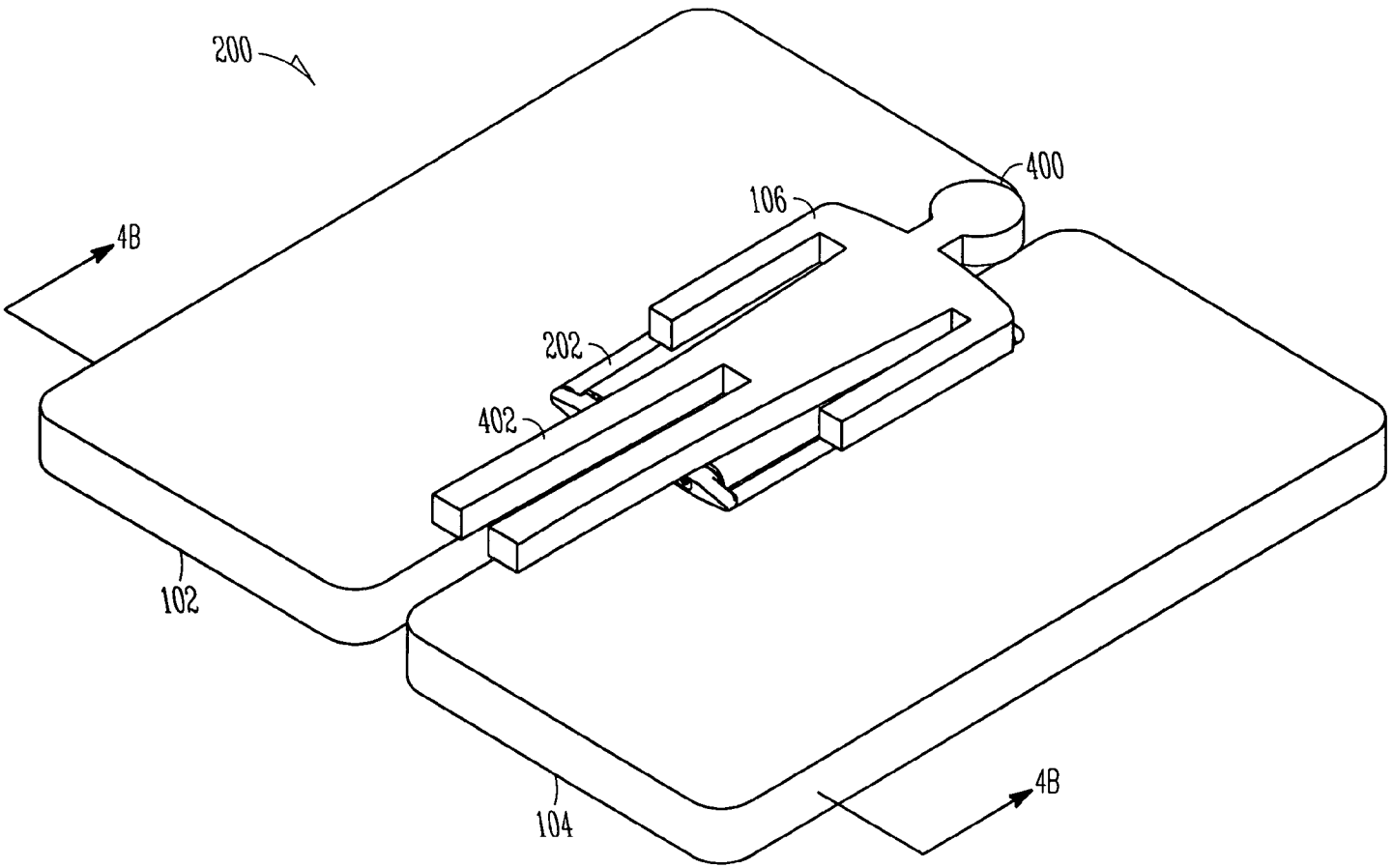

FIG. 4A illustrates the beginning stages of the transfer of subject 106 from first support surface 102 toward second support surface 104 using conveyor assembly 202. According to one technique, attendant 204 (FIG. 2) actuates conveyor assembly 202 (e.g., via an input device 1202 (FIG. 12)) while one or more other attendants support the subject's head 400 or legs 402 above support surfaces 102, 104. In one example, conveyor assembly 202 comprises a head 1604 or leg 1606 support extension (see FIG. 16) or is designed to have a length longer (than that shown) thereby supporting a greater portion of the subject's 106 body. Either option may negate the need for one or more attendants during the transfer of subject 106 (i.e., additional attendants may not be needed to support the subject's head 400 or legs 402).

Figure 4B:
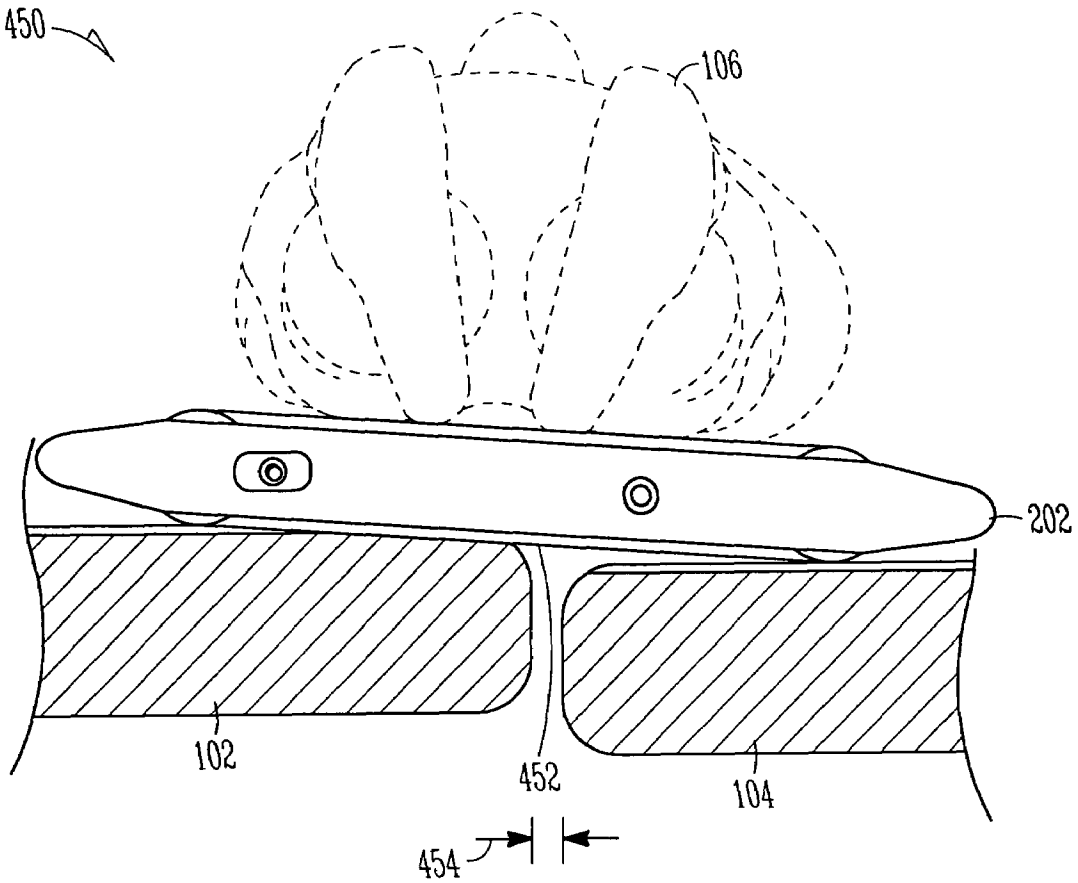

FIG. 4B is a cross-sectional view 450 taken along line 4B-4B of FIG. 4A, which illustrates subject 106 in the course of being transferred from first support surface 102 to second support surface 104 using conveyor assembly 202. Advantageously, conveyor assembly 202 has the ability to traverse uneven support surfaces 102, 104, as shown. During the transfer process, conveyor assembly 202 moves in a continuous conveying motion rolling upon itself (i.e., conveyor assembly 202 rides on a belt portion 452 located between assembly 202 and support surfaces 102, 104 at any given time). By rolling upon itself, conveyor assembly 202 moves subject 106 a distance approximately 2× (i.e., twice) a distance traveled by the assembly itself.

As discussed in greater detail below, conveyor assembly 202 is constructed with enough rigidity and strength so that during the transfer process a transfer surface is maintained between the two support surfaces 102, 104 to reduce the likelihood that bodily appendages of subject 106 will fall into a narrow gap 454 existing between surfaces 102, 104. In other words, conveyor assembly 202 is adapted to support the weight of subject 106 with minimal, if any, structural deformation. Also noteworthy is that the contact area between conveyor assembly 202 and subject 106 does not change during the transfer process. At all transfer stages of subject 106 from first support surface 102 to destination second support surface 104, a substantial width of subject 106 is in contact with conveyor assembly 202.

Figure 5:
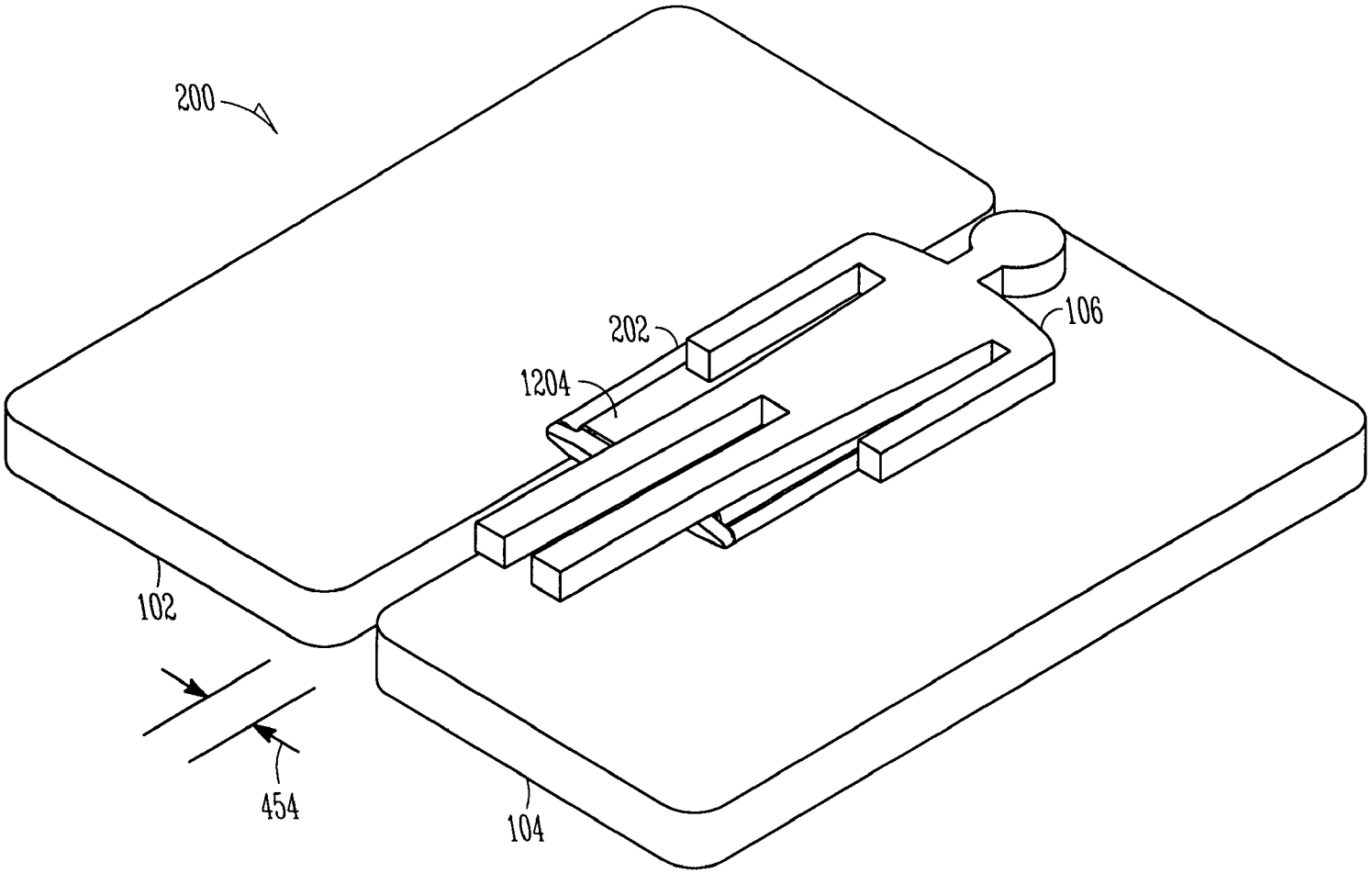
Figure 6:
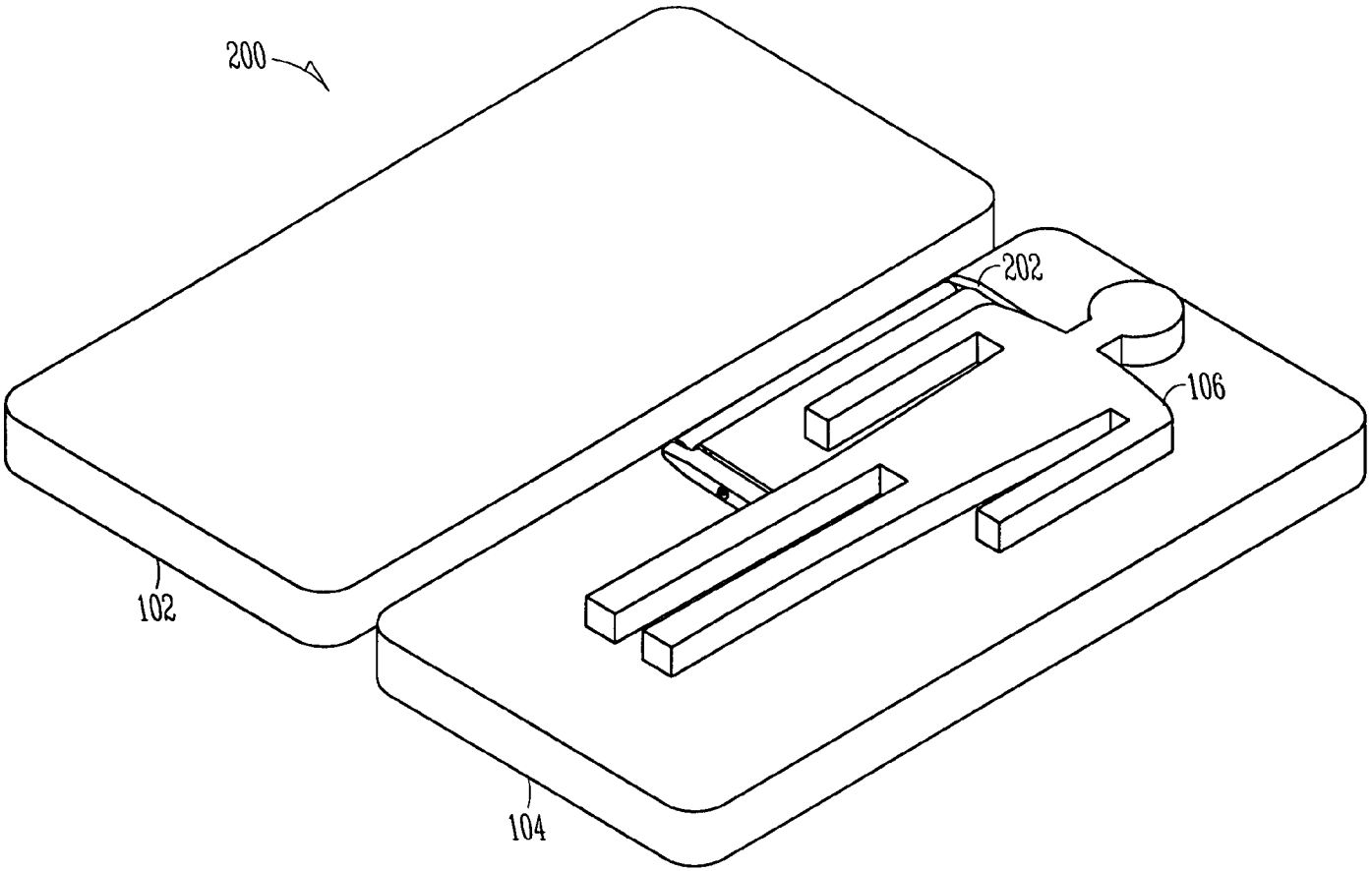
Figure 12:
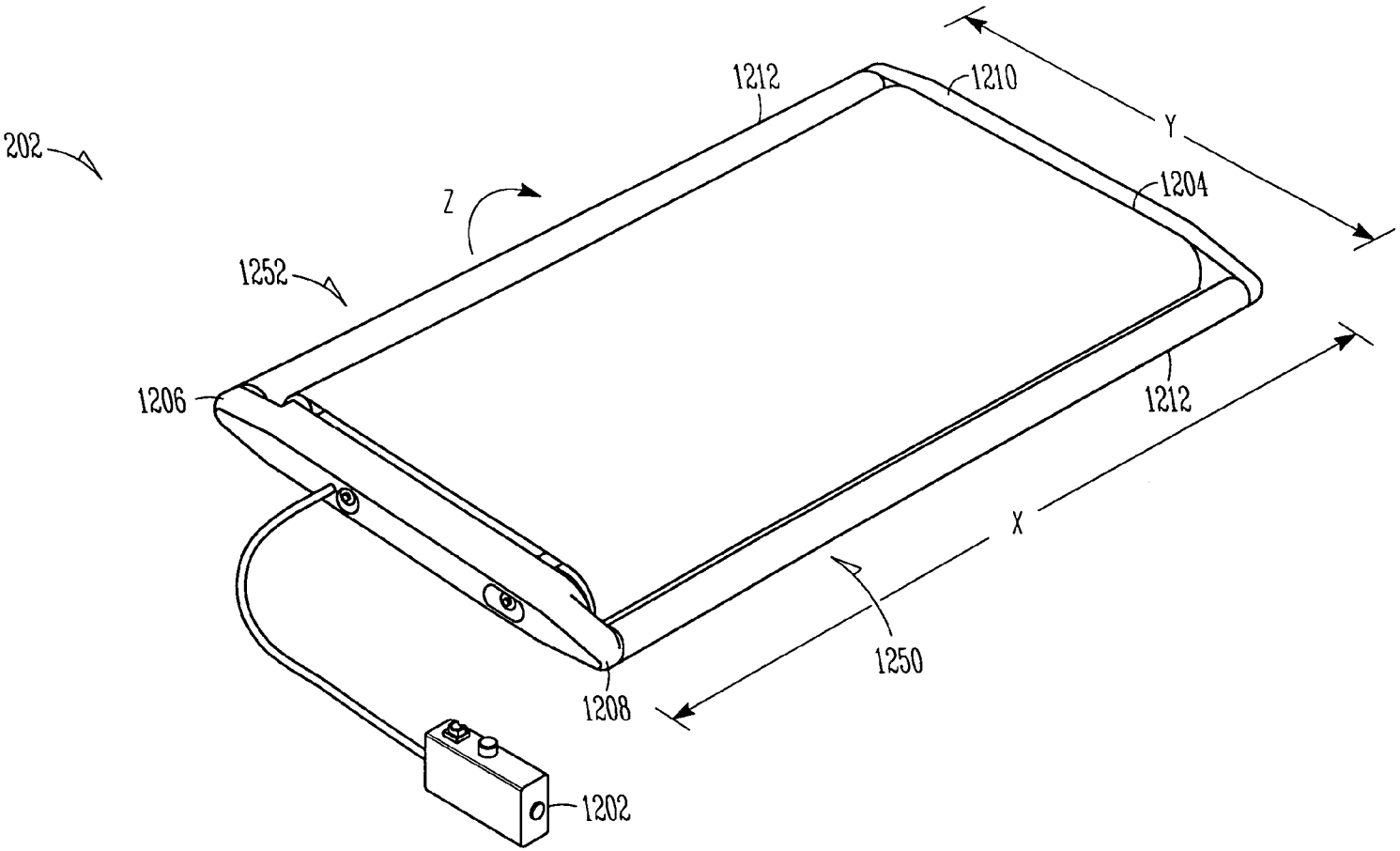
FIG. 12 is an isometric view illustrating a conveyor assembly, as constructed in accordance with at least one embodiment.

In FIGS. 5-6, the transfer progression of subject 106 from first support surface 102 to second support surface 104 using conveyor assembly 202 is shown. Specifically, FIG. 5 illustrates subject 106 being conveyed from first support surface 102, over gap 454, to second support surface 104. As conveyor assembly 202 traverses over horizontal support surfaces 102, 104, subject 106 (as discussed above) is conveyed on belt 1204 (see also FIG. 12) along the top of conveyor assembly 202 at approximately twice the distance traveled by assembly 202. In FIG. 6, conveyor assembly 202 and subject 106 are shown located on second support surface 104 as desired. Upon subject 106 reaching such desired location on second support surface 104, attendant 204 (FIG. 2) stops actuation of conveyor assembly 202 by, for example, releasing a run button on input device 1202 (FIG. 12).

Figure 7:
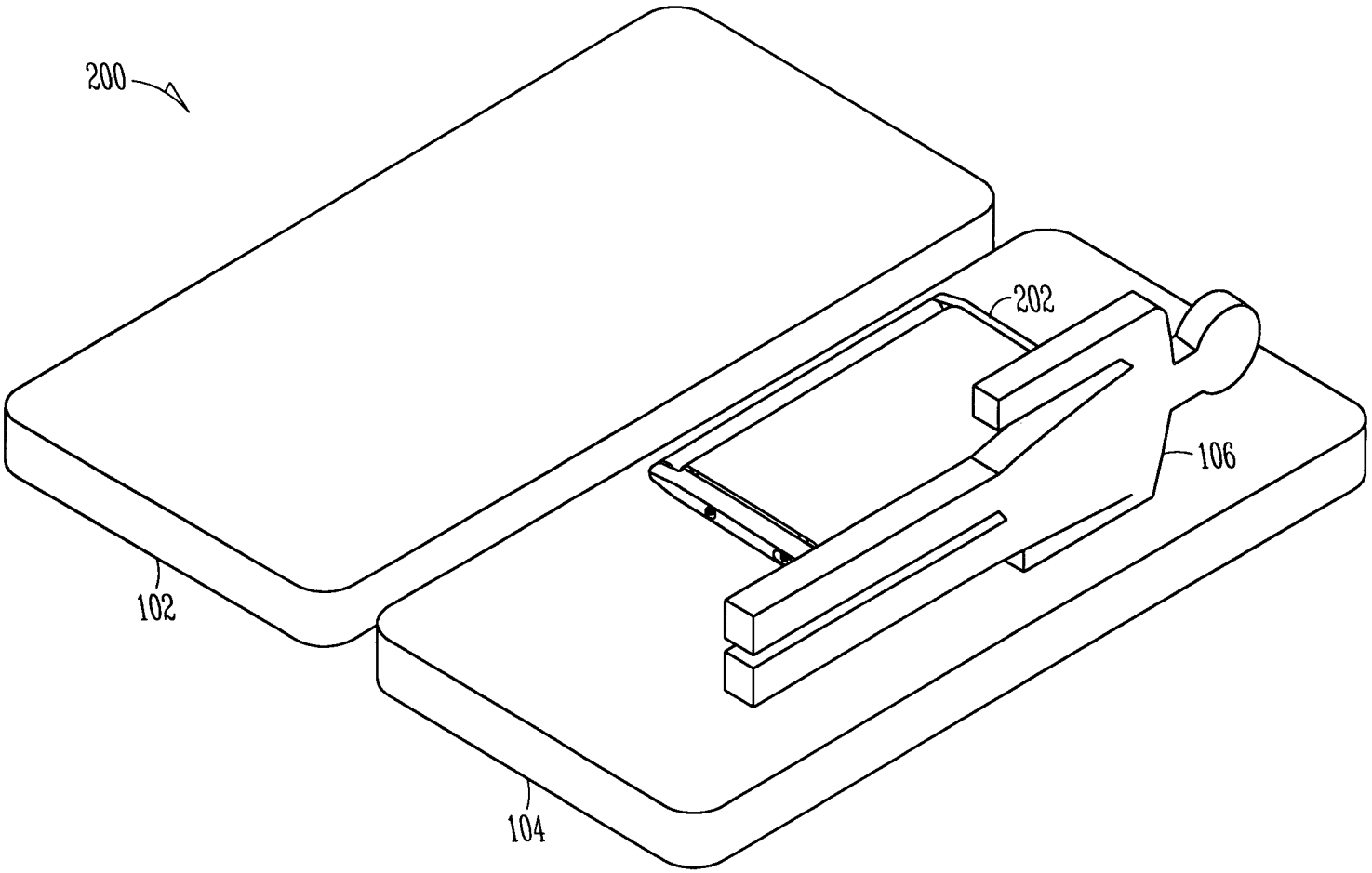
Figure 8:
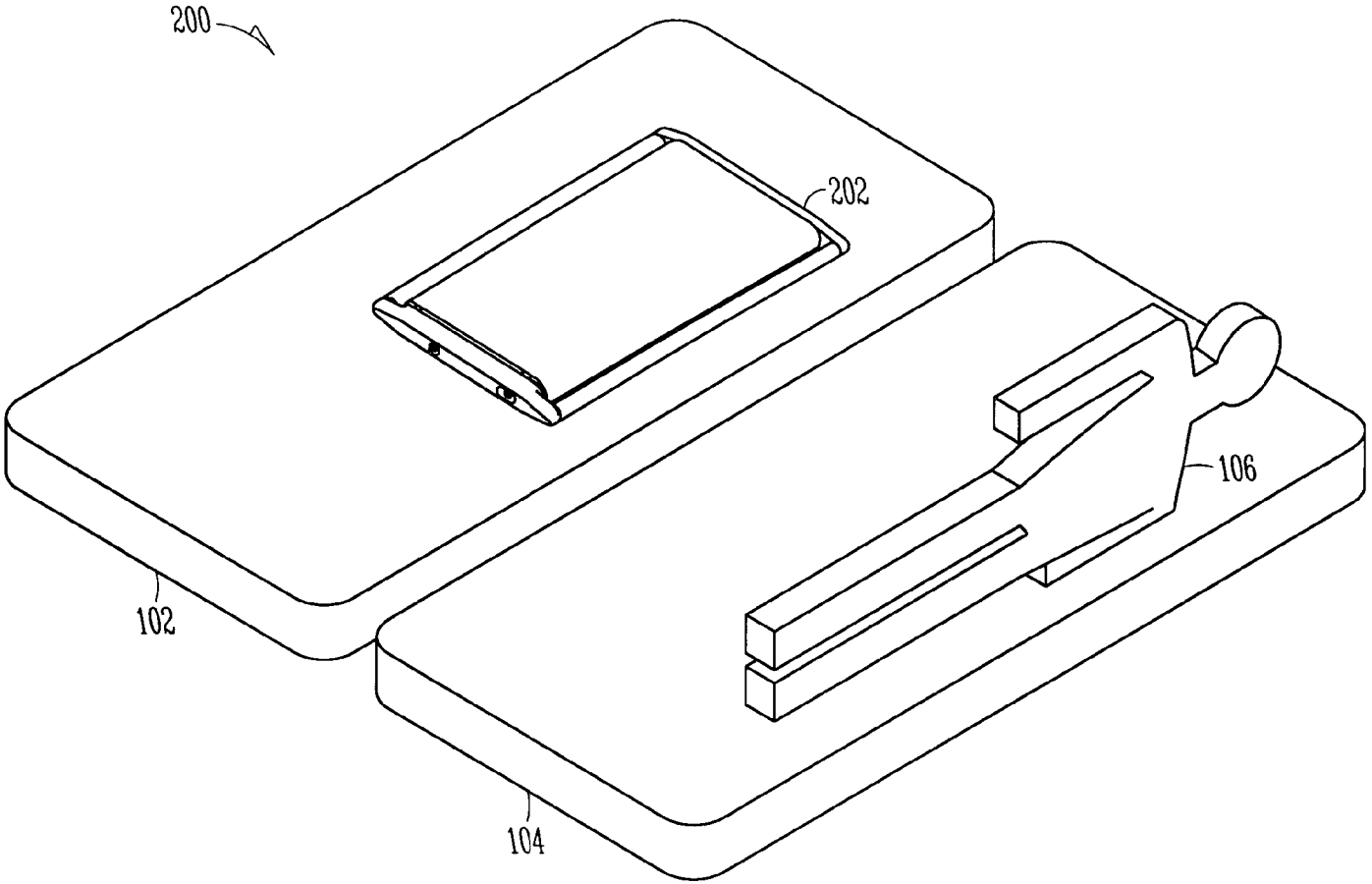
Figure 9:
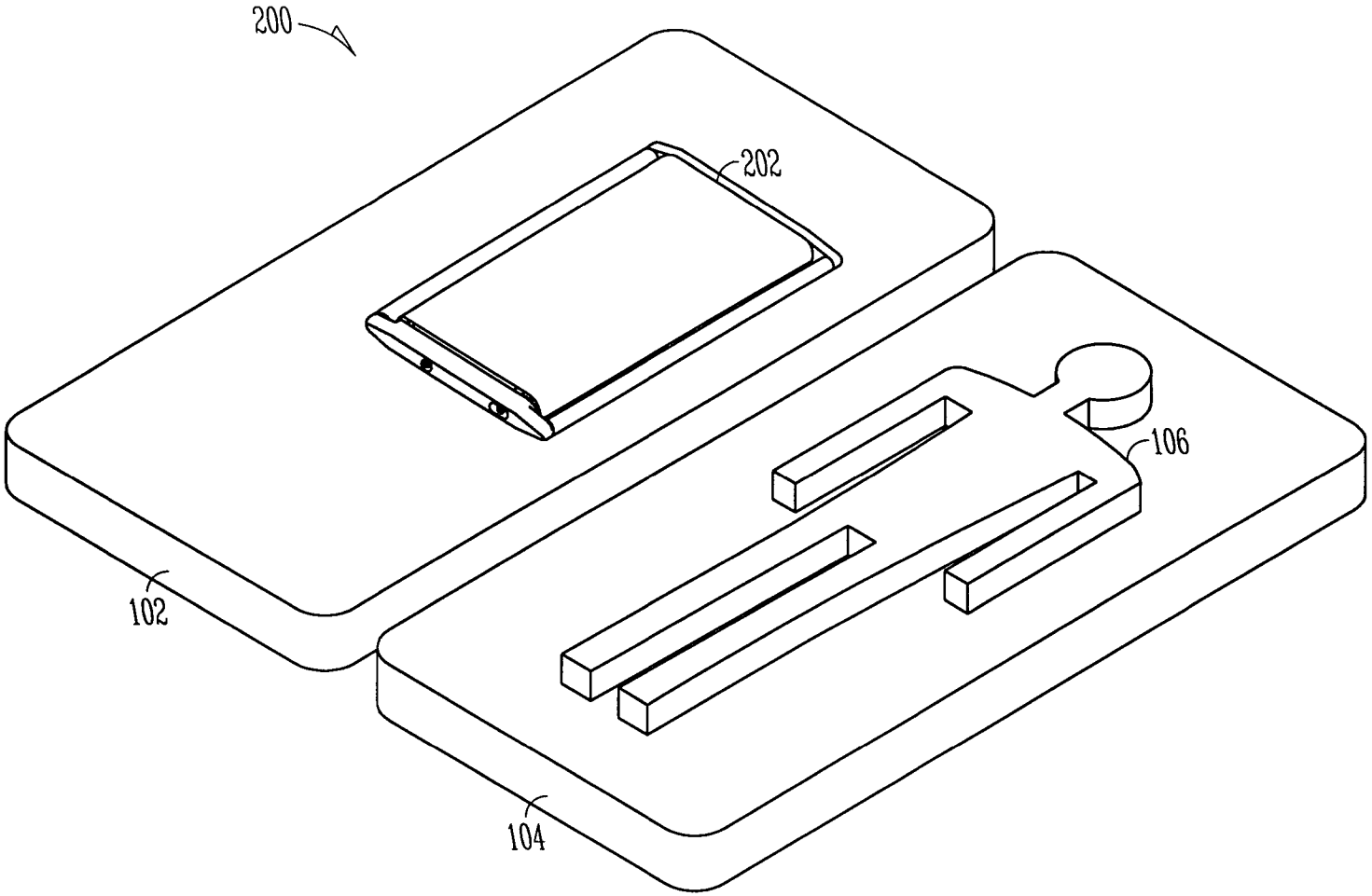

FIGS. 7-9 illustrate the final transfer steps of method 200. Specifically, FIGS. 7-9 illustrate method 200 steps that may occur after subject 106 and conveyor assembly 202 are substantially positioned on second support surface 104. In FIG. 7, an attendant (not shown) log rolls subject 106 onto his/her side off conveyor assembly 202 such that subject 106 is facing away from the surface where subject 106 was initially lying (i.e., first support surface 102). FIG. 8 illustrates the removal or repositioning of conveyor assembly 202 from a position near subject 106 to first support surface 102. Conveyor assembly 202 may be removed or repositioned by actuation of assembly 202 in a reverse direction (i.e., away from second support surface 104 and subject 106) or by application of a removal force exerted by an attendant. Finally, FIG. 9 illustrates subject 106 rolled onto his/her back in the prone position on second support surface 104, thus concluding the transfer of subject 106 from first support surface 102 to second support surface 104 using conveyor assembly 202.

Figure 10:
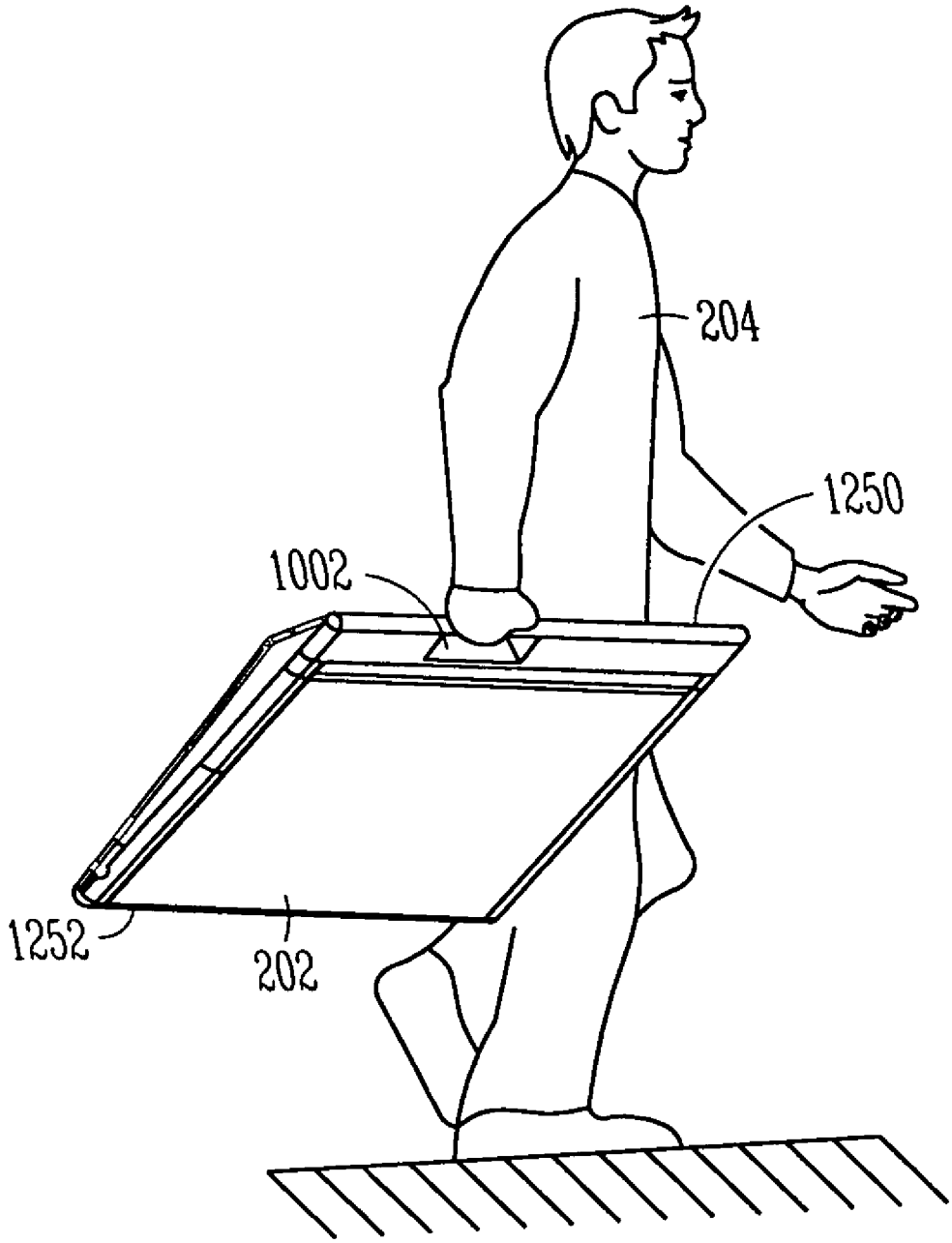
FIG. 10 is a schematic view illustrating a worker carrying a conveyor assembly, as constructed in accordance with at least one embodiment.

FIG. 10 illustrates a health care or other worker 204 carrying a conveyor assembly 202 according to one example of the present invention. As shown, conveyor assembly 202 may include a handle 1002 adapted for carrying conveyor assembly 202 during transfer of the same from, for example, a storage location (e.g., closet or storage room) to a desired subject transfer location (e.g., room in which a subject 106 (FIG. 1) is to be transferred from a first support surface to a second support surface). Also shown in this example, conveyor assembly 202 may comprise a narrower side 1252 and a wider side 1250, thereby allowing for easier insertion of the assembly between subject 106 and first support surface 102 (FIG. 2). Advantageously, conveyor assembly 202 provides a compact, portable design that allows a caregiver, whether in an institutional setting such as a hospital or a nursing home, or in a home setting, to be able to comfortably move a subject 106 between two support surfaces without injuring the subject or the worker, and be able to easily store such conveyor assembly 202 when not in use.

Figure 11:
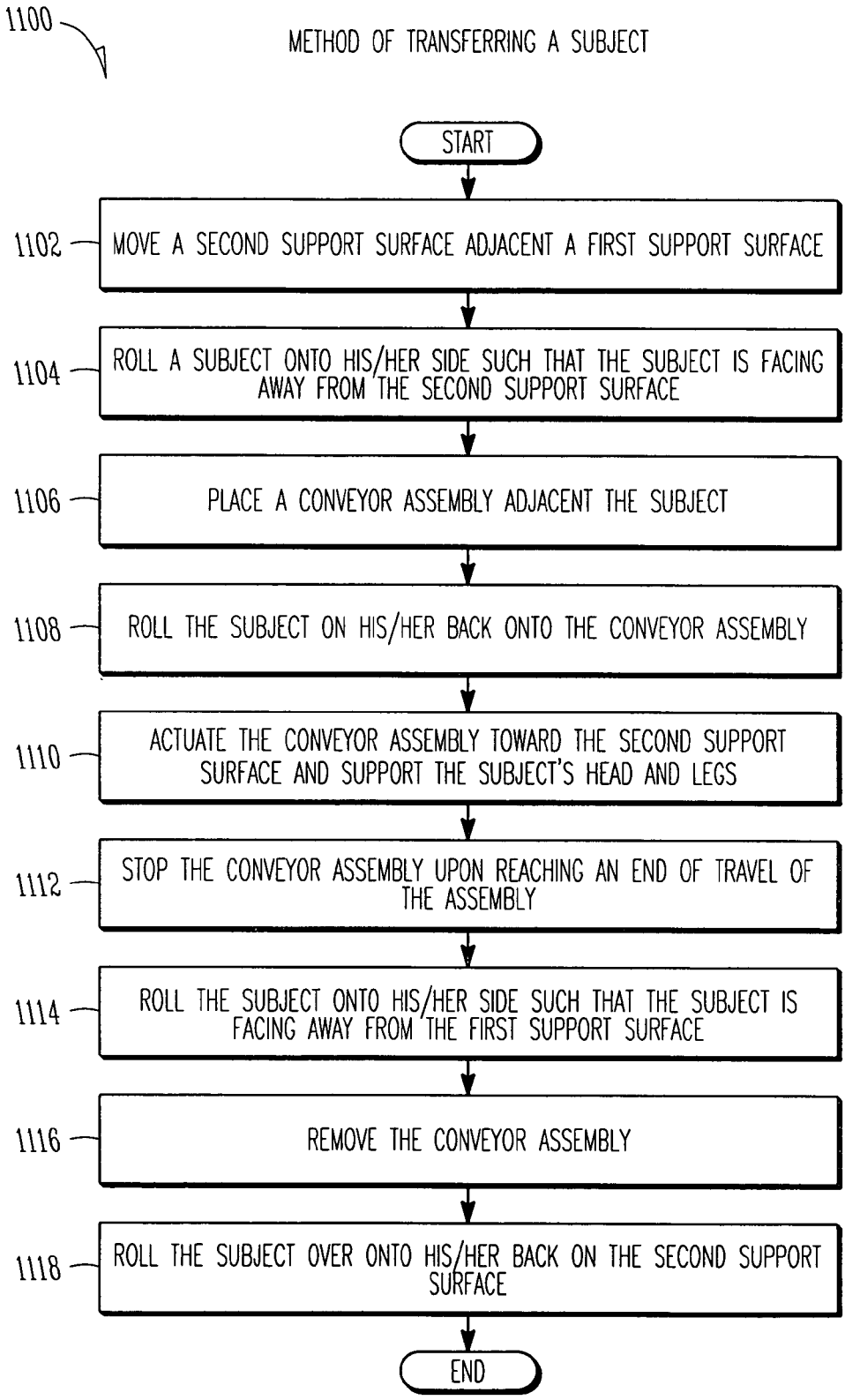
FIG. 11 is a flow diagram illustrating a method of transferring a subject from a first support surface to a second support surface, as constructed in accordance with at least one embodiment.

FIG. 11 is a flow diagram textually illustrating a method 1100 of transferring a subject from a first support surface to a second support surface. As a preliminary note, a similar method is pictorially illustrated in FIGS. 2-9 and described in the discussion associated therewith. At 1102, the second support surface is moved to a position adjacent the first support surface. Once at the desired adjacent position, the wheels linked to the second support surface may be locked to prevent unwanted surface movement of the same during the transfer of the subject. At 1104, the subject is rolled onto his/her side such that the subject is facing away from the second support surface (i.e., the subject's back is closer to the second support surface than the subject's chest). At 1106, a portable, motor-driven conveyor assembly is longitudinally centered near the subject's torso. In one example, the conveyor assembly is designed narrower on a conveyor trailing side than on a conveyor leading side (see, e.g., the conveyor assembly illustrated in FIG. 10). In such an example, the conveyor assembly is placed next to the subject such that the trailing side is placed nearest the subject). At 1108, the subject is rolled on his/her back onto the conveyor assembly. In one example, a first attendant may roll the subject on his/her side (at 1104) and subsequently onto his/her back (at 1108), while a second attendant places the conveyor assembly near the subject (at 1106). In another example, a single attendant both rolls the subject and places the conveyor assembly near the subject as desired.

After the conveyor assembly is inserted between the subject and the first support surface, the subject may be transferred to the second support surface. To effectuate such transfer, the conveyor assembly, at 1110, is actuated toward the second support surface while the subject's head and legs are supported. In one example, the subject's head or legs are supported by an attendant. In another example, the conveyor assembly is adapted to support the subject's head or legs, thus negating the need for a worker(s) to do the same. At 1112, the conveyor assembly is stopped when the subject reaches an end of travel on the assembly's belt or has reached the desired location on the second support surface.

Upon reaching the end of travel, the subject is rolled, at 1114, onto his/her side on the second support surface such that the subject is facing away from the first support surface (i.e., the subject's back is closer to the first support surface than the subject's chest). At 1116, the conveyor assembly is removed by actuating or lifting the assembly away from the subject. Finally, at 1118, the subject is rolled on his/her back on the second support surface, thereby completing the transfer of the subject from the first support surface to the second support surface.

FIG. 12 is an isometric view of an exemplary conveyor assembly 202 for transferring a subject 106 (FIG. 1) from a first support surface 102 (FIG. 1) to a second support surface 104 (FIG. 1). As shown, conveyor assembly 202 comprises, among other things, an assembly frame 1206, a belt 1204, an input device 1202, and one or more roller guards 1212. Assembly frame 1206 longitudinally extends from a frame first end 1208 to a frame second end 1210. In one example, a longitudinal length X of conveyor assembly 202 is 2-3 ft. (24-36 in.), while a width Y of conveyor assembly 202 is between 1-2 ft. (12-24 in.). In this example, belt 1204 is mounted between frame ends 1208, 1210 and is adapted to rotate in a direction Z perpendicular to length X of conveyor assembly 202. Input device 1202 is adapted to receive command instructions from a worker and relay such commands to conveyor assembly 202. For instance, input device 1202 may be adapted to receive instructions related to a conveyor speed, direction, or power on/off. In addition, input device 1202 may provide an indication (e.g., via an indicator light) for a power source 1404 (FIG. 14A) charge remaining or provide a connection to an external power source to recharge power source 1404 (e.g., rechargeable batteries).

In the example shown, roller guards 1212 are mounted on the leading 1250 and trailing 1252 sides of conveyor assembly 202 (wherein leading side 1250 is the first portion of conveyor assembly 202 to reach the second support surface 104 (FIG. 4A) during a transfer of subject 106) and are typically rigidly constrained between assembly frame ends 1208, 1210. In one example, however, roller guards 1212 are rotatably mounted to assembly frame ends 1208, 1210 to allow for rotation of the same. Such rotational ability of roller guards 1212 may aid in the positioning of a subject 106 (FIG. 1) on conveyor assembly 202. In another example, conveyor assembly 202 includes no roller guard 1212 on trailing side 1252. Rather, in such an example, conveyor assembly 202 may be shaped narrower on assembly trailing side 1252 than assembly leading side 1250 (see, e.g., FIG. 10, which illustrates conveyor assembly 202 comprising a wedge shape design) for easier placement between subject 106 and first support surface 102 (FIG. 2).

Roller guards 1212 may serve a variety of functions alone or in combination with other conveyor assembly 202 components. For instance, guards 1212, when combined with one or more wipers 1902 (FIG. 19) serve to keep any portion of subject's 106 body or fabric (i.e., clothing) from being caught in between belt 1204 and assembly frame 1206. As another example, roller guards 1212 provide conveyor assembly 202 with narrow sides to facilitate subject 106 positioning on (see FIGS. 2, 3), and discharge from (see FIGS. 6, 7), assembly 202. As yet another example, roller guards 1212 may be used as a handle for transporting conveyor assembly 202 from, for example, a closet to a desired subject transfer location (i.e., in lieu of a specifically designed handle 1002 (FIG. 10)).

Figure 13:
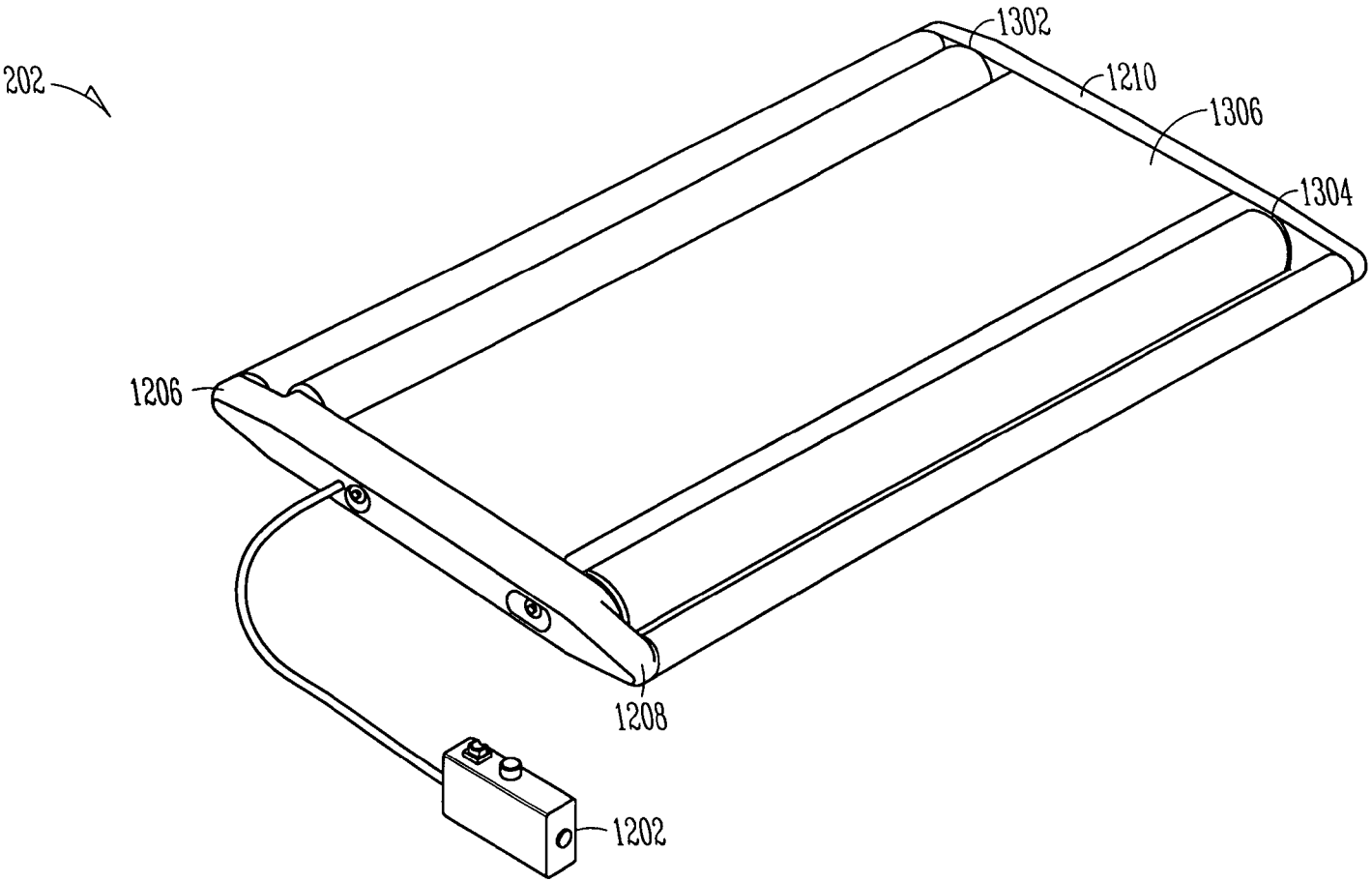
FIG. 13 is an isometric view illustrating a conveyor assembly with the belt removed, as constructed in accordance with at least one embodiment.

FIG. 13 illustrates an example of a conveyor assembly 202 with the belt 1204 (FIG. 12) removed. As can be seen with belt 1204 removed, conveyor assembly 202 may comprise, among other things, a first roller 1302, a second roller 1304 parallel with and spaced apart from first roller 1302, an assembly frame 1206 extending from a frame first end 1208 to a frame second end 1210, an input device 1202, and a belt support 1306. In this example, first and second rollers 1302, 1304 (respectively) are rotatably support at their ends by frame first 1208 and second 1210 ends and belt support 1306 is mounted to assembly frame 1206 between the rollers. In one example, first roller 1302 comprises a drive roller that is adapted to receive a motor-generated rotational force and transfer such force to belt 1204 (FIG. 12). In another example, second roller 1304 comprises an idle roller adapted to freely rotate and guide belt 1204 back to a drive roller.

Figure 16:
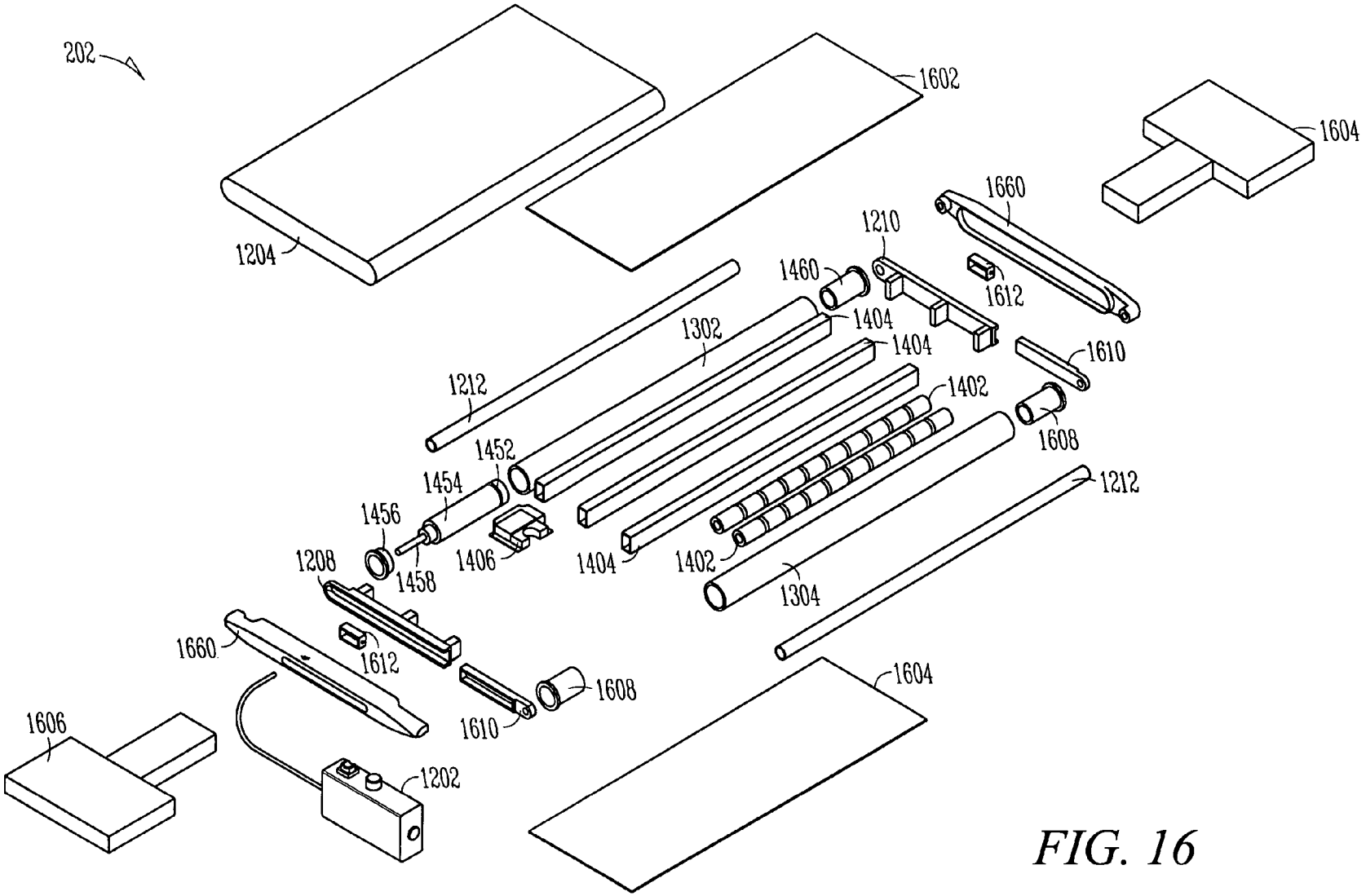
FIG. 16 is an exploded view illustrating components of a conveyor assembly, as constructed in accordance with at least one embodiment.

Belt support 1306 includes an upper support surface 1602 (FIG. 16) and a lower support surface 1604 (FIG. 16). Upper support surface 1602, which is mounted to a top side of assembly 202, provides a surface upon which belt 1204 (FIG. 12) may slide while supporting a subject 106 (FIG. 1). Lower support surface 1604, which is mounted on a bottom side of assembly 202, provides a surface upon which subject 106 and conveyor assembly 202 slides on while moving or crawling across the first and second support surfaces 102, 104 (respectively). In varying examples, upper 1602 and lower 1604 support surfaces comprise a polymer (e.g., TEFLON®, a registered trademark of DuPont®) or other material having a low coefficient of friction, such as about 0.35 or less, with belt 1306 on belt contacting portions thereof.

Figure 14A:
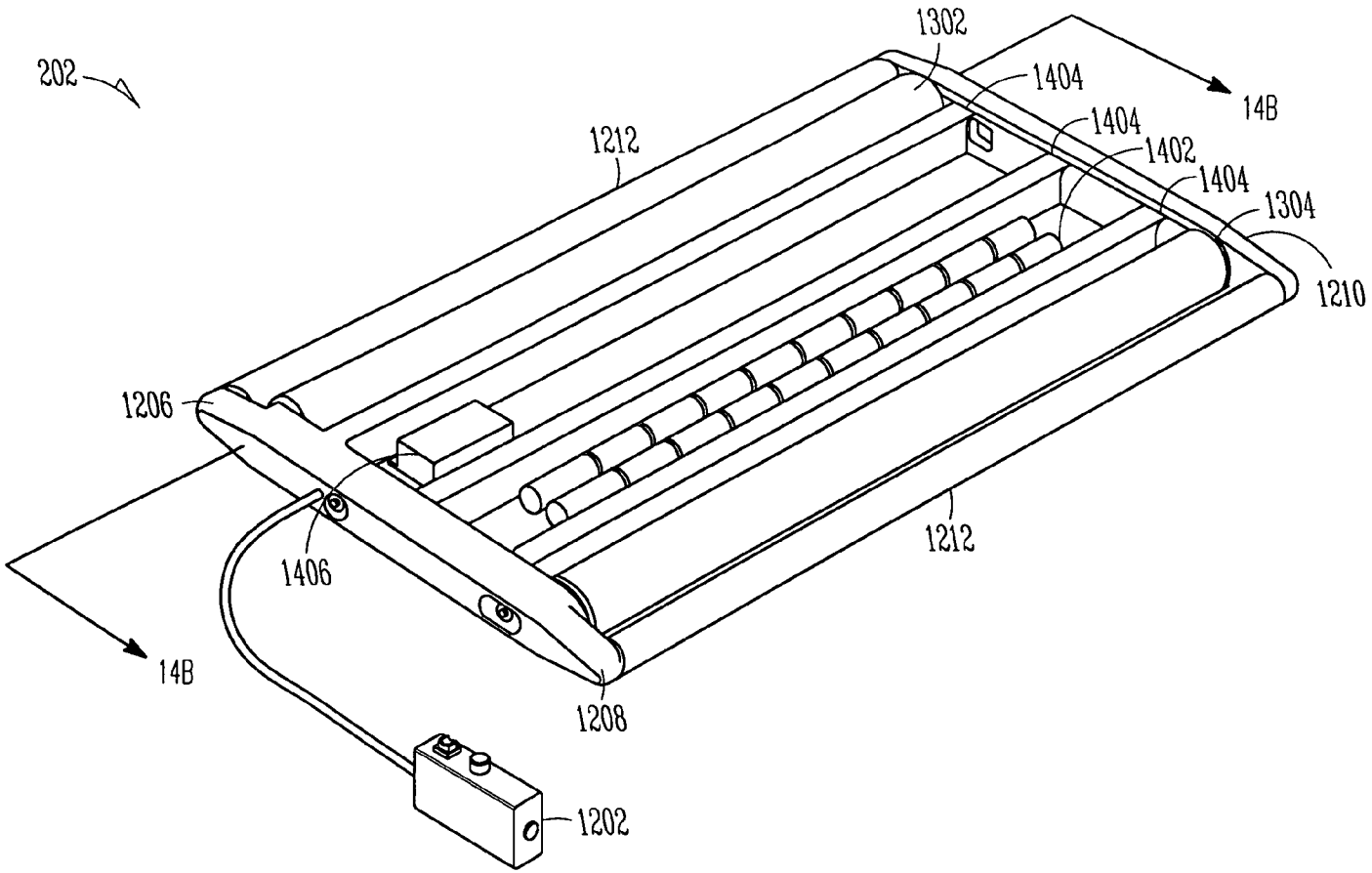
FIG. 14A is an isometric view illustrating a conveyor assembly with the belt and the upper belt support removed, as constructed in accordance with at least one embodiment.

FIG. 14A illustrates an example of a conveyor assembly 202 with the belt 1204 (FIG. 12) and upper support surface 1602 (FIG. 16) removed. As can be seen with both belt 1204 and upper (belt) support surface 1602 removed, conveyor assembly 202 may comprise, among other things, a first roller 1302, a second roller 1304 parallel with and spaced apart from first roller 1302, an assembly frame 1206 longitudinally extending from a frame first end 1208 to a frame second end 1210 and connected via one or more frame spacers 1404, one or more roller guards 1212, an input device 1202, a power source 1402, and a controller 1406.

In this example, conveyor assembly 202 is powered by power source 1402, which is disposed in an enclosed area defined by frame first 1208 and frame second 1210 ends and first 1302 and second 1304 rollers. As shown, power source 1402 comprises one or more (rechargeable) batteries, such as FORTIS-A brand batteries having an outer diameter of 0.6 in., aligned end-to-end along a length X (FIG. 12) of conveyor assembly 202. To easily insert or remove the one or more batteries from the enclosed area, conveyor assembly 202 may comprise a removable power source cap covering a slightly larger than battery-sized hole integrated in frame first 1208 or frame second 1210 end. In another example, power source 1402 is disposed within a lumen of first 1302 or second 1304 roller. In yet another example, power source 1402 may be disposed outside of conveyor assembly 202. In one such example, power source 1402 may comprise electricity from a wall outlet that is transferred to conveyor assembly 202 via a power cord. In another such example, power source 1402 may include one or more batteries non-integral with conveyor assembly 202.

In the example shown, controller 1406 connects input device 1202 and power source 1402 to a motor 1450 (FIG. 14B) of conveyor assembly 202. As such, controller 1406 is adapted to receive user-generated command instructions transmitted by input device 1202, process the instructions, and subsequently rely representative signals and necessary power to motor 1450. In this example, controller 1406 is disposed between the ends 1208, 1210 of assembly frame 1206. In another example, a pulse width modulator coupled with a potentiometer may be used in lieu of controller 1406. In such an example, the pulse width modulator converts a DC voltage from power source 1402 into a series of pulses such that the pulse duration is directly proportional to the value of the DC voltage, which is adjustable. As a result, motor 1450 is able to maintain high torque values at a variety of speeds. One example of a suitable pulse width modulator for use in conveyor assembly 202 is a DC-motor speed control, Model No. 25A-24V, having the ability to delivery 25 amps of continuous current at 24VDC with 0 to 98% duty, manufactured by Midwest-Motion of Watertown, Minn., USA. Using a pulse width modulator coupled with a potentiometer may allow for, among other things, an overall weight reduction of conveyor assembly 202 or a narrower assembly 202 profile.

As discussed, assembly frame 1206 extends from frame first end 1208 to frame second end 1210. In this example, such frame ends 1208, 1210 are connected to one another via one or more frame spacers 1404. Frame spacers 1404 provide structural support to conveyor assembly 202 by way of connecting frame ends 1208, 1210 and providing a surface upon which belt support 1306 may be coupled to. In one example, but as may vary, assembly frame 1206 and frame spacers 1404 are composed of aluminum, which provides conveyor assembly 202 with good strength, resistance to corrosion and rust, and weight reduction. In another example, conveyor assembly 202 is provided with further structural support through the use of a structural filler disposed in the voids between frame spacers 1404. In one such example, a lightweight honeycomb or like structure filler comprising aluminum, polymer, or foam is disposed between frame spacers 1404 and provides the additional structural support. In yet another example, belt support 1306 is supported solely by the use of the lightweight honeycomb or like structure filler (i.e., without the use of frame spacers 1404).

Figure 14B:
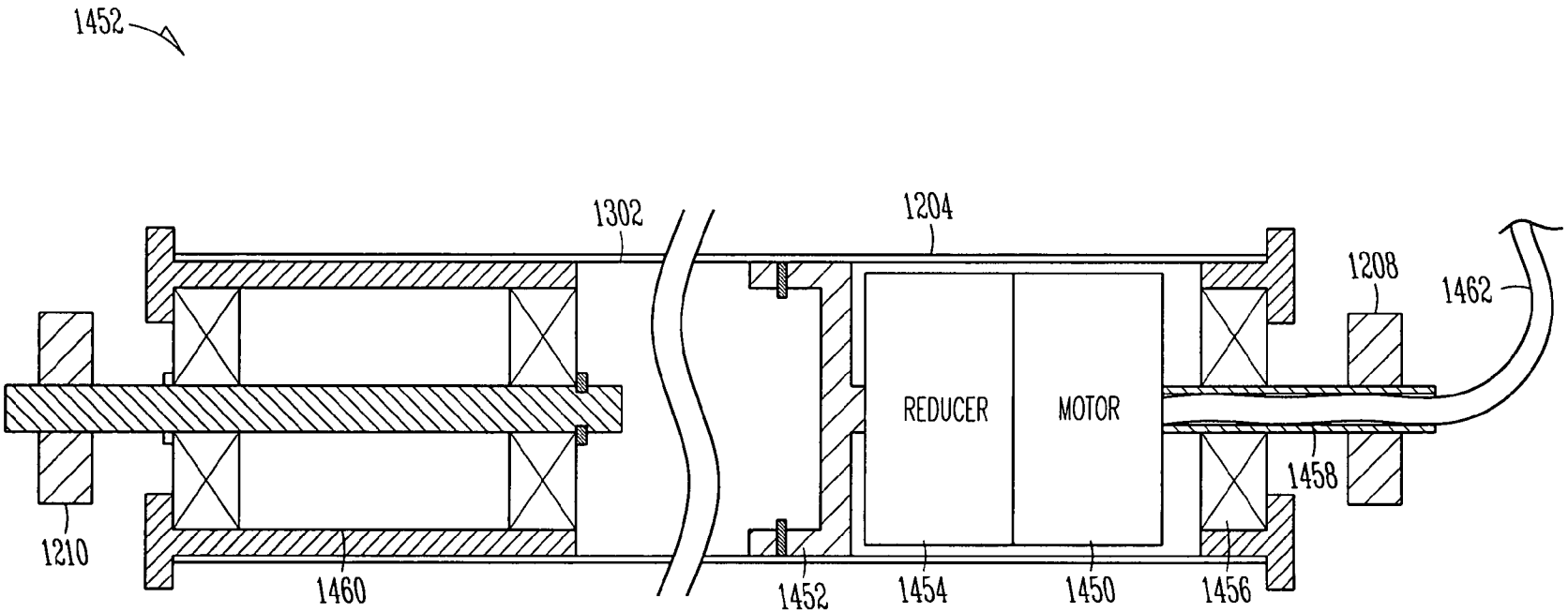
FIG. 14B is a cross-sectional view taken along line 14B-14B of FIG. 14A, as constructed in accordance with at least one embodiment.

FIG. 14B is a cross-sectional view illustrating a motor connection arrangement 1452 taken along line 14B-14B of FIG. 14A. In the exemplary conveyor assembly 202 of FIG. 14A, a motor 1450 and a driving speed reducer 1454 is disposed within a lumen of first roller 1302 and coupled (via a coupler 1452) to an inner surface thereof. As shown, motor 1450 is held stationary, that is, fixed relative to assembly frame 1208 (specifically, a frame first end 1208). First roller 1302, on the other hand, is rotatably coupled on its respective ends to frame first end 1208 and frame second end 1210 by way of bearings 1456, 1460. In one example, at least one of bearings 1456, 1460 is designed with one or more voids to provide conveyor assembly 202 with overall weight reduction. In this example, a hollow shaft or extension 1458 of motor 1450 is used to support bearing 1456 and provide a passage for one or more electrical wires 1462 (e.g., from power source 1402, controller 1406 or pulse width modulator) that supply power to, and control for, motor 1456.

Figure 17:
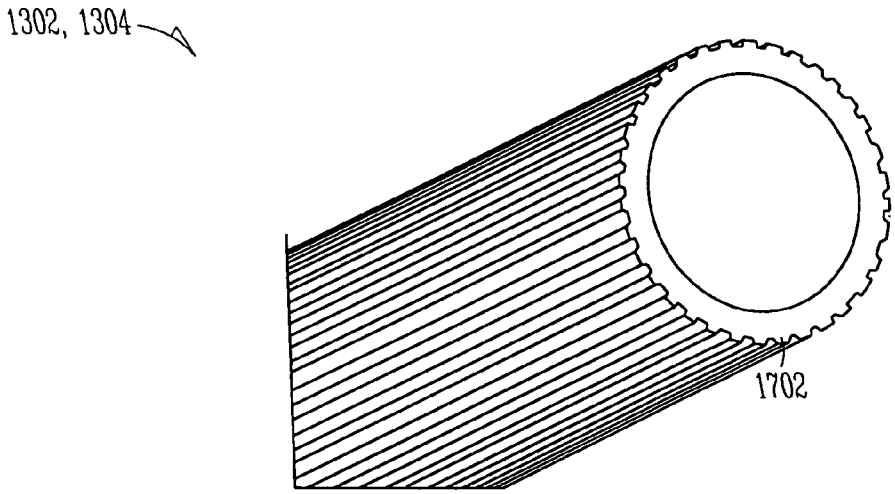
FIG. 17 is an isometric view illustrating a portion of a first or a second roller of a conveyor assembly, as constructed in accordance with at least one embodiment.
Figure 18:
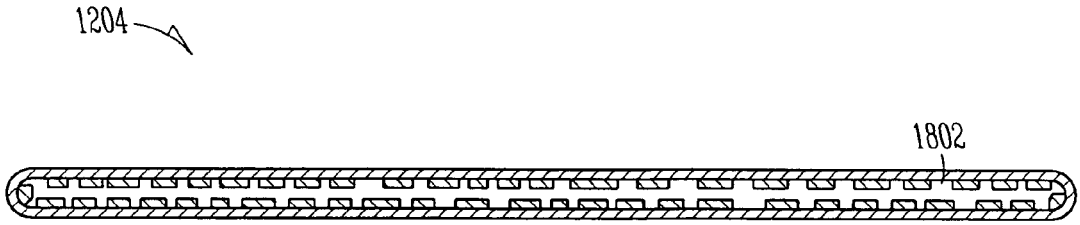
FIG. 18 is a cross-sectional view of the belt of a conveyor assembly, as constructed in accordance with at least one embodiment.

The stationary mounting of motor 1450 and rotational mounting of first roller 1302 (relative to assembly frame ends 1208, 1210) allows motor 1450 to drive (i.e., rotate) first roller 1302 when such elements are coupled. As a result, when a belt 1204 is coupled to an outer surface of first roller 1302, rotation of motor 1450 in turn causes rotation of belt 1204. As illustrated in FIGS. 17-18, one way among many, to rotatably couple first roller 1302 to belt 1204 comprises the use of matable projections (e.g., teeth) in combination with projection receiving portions 1702, 1802. FIG. 14B represents only one possible motor connection arrangement 1452. One example of a suitable motor 1450 for use in conveyor assembly 202 (FIG. 14A) is a brushed motor producing 1200 in.-lbs. (peak) of torque and having an outer diameter of about 2-2.25 in., manufactured by Midwest-Motion of Watertown, Minn., USA. However, other motors 1450, such as a brushless motor, may also be used without departing from the scope of the present assemblies 202 and methods.

Figure 15:
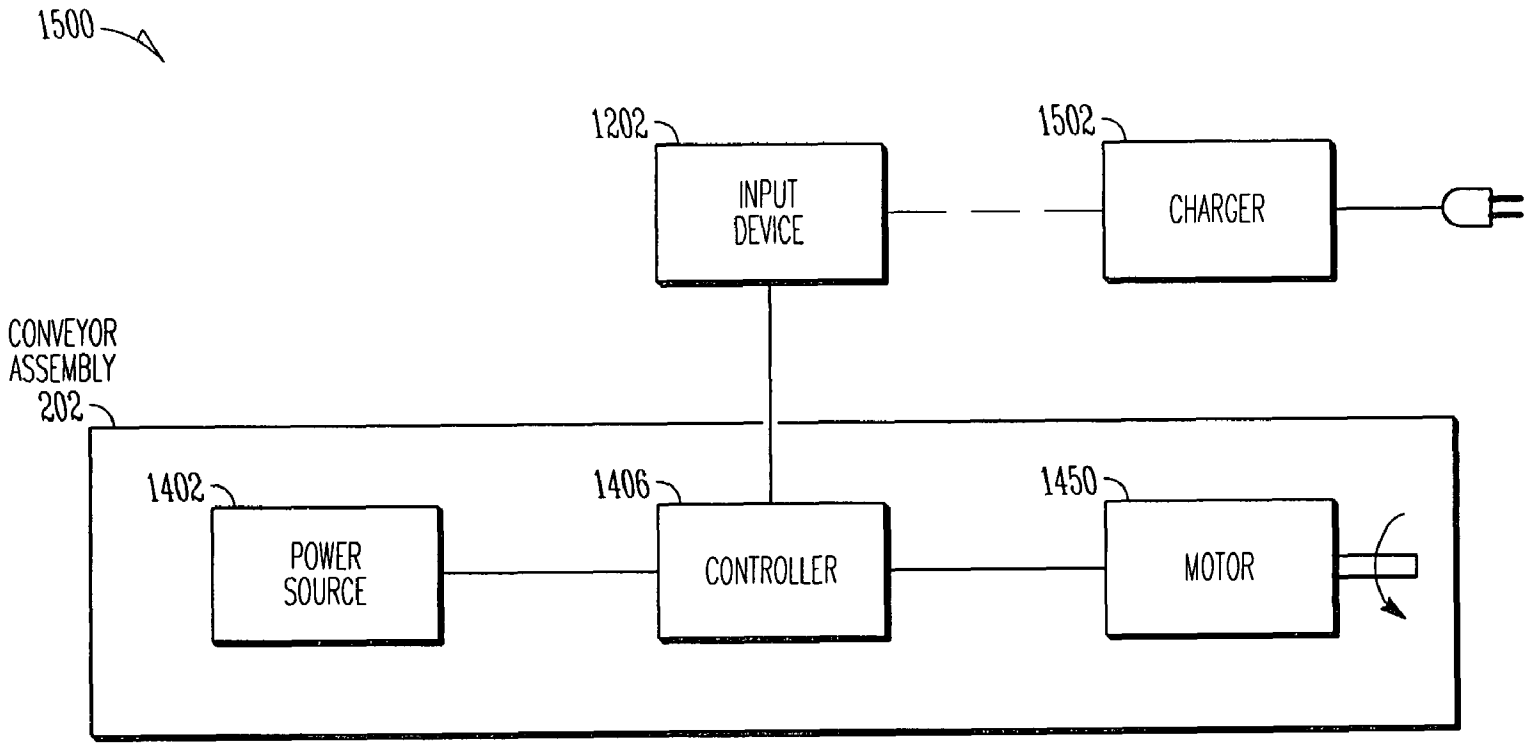
FIG. 15 is a block diagram illustrating connections between components of a conveyor assembly, as constructed in accordance with at least one embodiment.

FIG. 15 is a block diagram illustrating electrical connections 1500 between components of a conveyor assembly 202. As discussed above, an input device 1202 is adapted to receive command instructions, such as instructions related to a conveyor speed or direction, from a user and communicate such instructions to a controller 1406. Upon receipt of the instructions, controller 1406 is adapted to send instruction-representative signals and necessary power from power source 1402 to motor 1450 to generate rotation (or other movement) thereof. As also discussed, input device 1202 may include a port for receiving (e.g., battery) charging electricity 1502 and transmit the same to assembly 202, specifically power source 1402. Alternatively, charger 1502 may be directly connected to power source 1402 via a charging port integrated in conveyor assembly 202.

FIG. 16 illustrates an exploded view of one possible arrangement of components used for a conveyor assembly 202 of the present invention. A belt 1204 is the principal surface upon which a subject 106 (FIG. 1) is moved or conveyed from a first support surface 102 to a second support surface 104. Belt 1204 is mounted on a first roller 1302 (e.g., a drive roller) and a second roller 1304 (e.g., an idle roller). First 1302 and second 1304 rollers are mounted between a frame first end 1208 and a frame second end 1210. In one example, drive roller is larger in diameter than idle roller. One or more roller guards 1212 are mounted on the leading and trailing sides of conveyor assembly 202 and rigidly or rotatably constrained between one or more end covers 1660 fastened to frame ends 1208, 1210. As discussed above, one or both of a head 1604 or leg 1606 support extension may be coupled to frame ends 1208, 1210 (respectively) to support corresponding limbs of subject 106.

A belt support 1306 comprising an upper support surface 1602 and a lower support surface 1604 is mounted to a top side and a bottom side, respectively, of conveyor assembly 202. Upper support surface 1602 provides the surface upon which belt 1204 slides while supporting subject 106. Lower support surface 1604 provides the surface upon which subject 106 and the conveyor assembly 202 slides on while moving or crawling across support surfaces 102, 104. In this example, upper support surface 1602 and lower support surface 1604 are mounted to one or more frame spacers 1404 extending between frame first end 1208 and frame second end 1210.

A motor 1454 is mounted to an inside of first roller 1302 via a coupling 1452. A first bearing 1456 is mounted on a hollow cantilever shaft 1458 that is integral to motor 1454. A second bearing 1460 is mounted opposite first bearing 1456 on first roller 1302. Bearings 1456, 1460 allow first roller to rotate relative to frame ends 1208, 1210 and connect to motor 1454. Hollow shaft 1458 allows electrical power or control wires from a power source 1402 or a controller 1406 to motor 1454. An input unit 1202 is coupled, via a cable or wirelessly (e.g., using radio signals), to controller 1406 to provide user-generated command instructions thereto. In addition, input unit 1202 may be coupled, via controller 1406, to power source 1402 to provide for recharging of power source 1402.

Second roller 1304 is mounted to frame first end 1208 and frame second end 1210 through one or more bearings 1608. The assembly frame also supports two adjustable tension or alignment devices each comprised, according to one example, of a bracket 1610 and a stop block 1612. Tension or alignment devices allow for the tensioning or alignment of belt 1204. For instance, belt 1204 may be tensioned by increasing the distance between brackets 1610 and stop blocks 1612 using an adjustment screw. It is important to provide adequate belt 1204 tension to avoid slippage of the same. Further, it is important that rotation of belt 1204 stay confided to within frame ends 1208, 1210 to promote belt 1204 longevity (e.g., to prevent wearing of belt 1204 edges). To this end, belt 1204 may need to be properly aligned using the tension or alignment devices.

FIGS. 17-18 provide one technique for coupling a first 1302 or a second 1304 roller to an underside of a belt 1204 for driving of the same. Referring first to FIG. 17, which provides an isometric view of a portion of first 1302 or second 1304 roller. In this example, an outer surface of roller 1302 or 1304 includes one or more belt driving projections 1702, such as drive teeth. In FIG. 18, a cross-section of belt 1204 is illustrated. As shown, the underside of belt 1204 may include one or more projection receiving portions 1802 matable with belt driving projections 1702 of roller 1302 or 1304. In one example, belt driving projections 1702 and projection receiving portions 1802 are of the same pitch so as to allow the driving of belt 1204 (by way of motor 1454) in a synchronous manner with first roller 1302 as it idles over second roller 1304. In another example, a belt conveying surface (i.e., an outer surface of belt 1204) is sterilizable. In yet another example, belt 1204 is composed of neoprene. Other geometries not shown in FIGS. 17-18 are also possible without departing from the scope of the present assemblies. In addition, first 1302 or second 1304 roller may instead (of comprising belt driving projections 1702) comprise a substantially smooth outer surface and, in such case, rely on friction to drive belt 1204.

Figure 19:
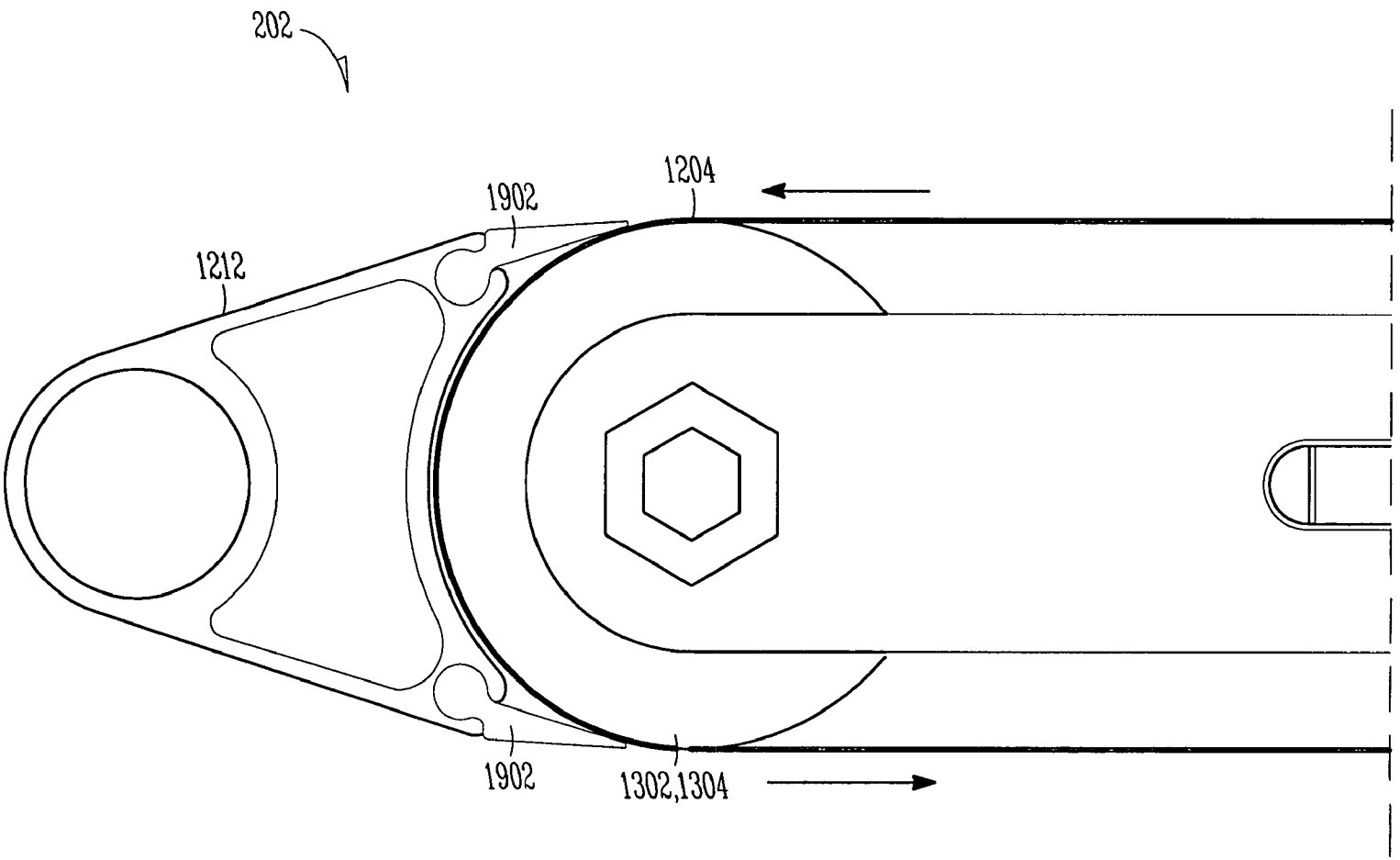
FIG. 19 is an end view illustrating a first or a second roller and a guard member therefore, as constructed in accordance with at least one embodiment.

FIG. 19 is an end view of a conveyor assembly 202 illustrating one example of a roller guard member 1212 positioned adjacent a first 1302 or a second 1304 roller. In this example, a wiper 1902 is coupled to roller guard member 1212 on a first wiper end and in contact with a belt 1204 on a second wiper end. Roller guard 1212 and wiper 1902 serve to keep any portion of a subject's 106 (FIG. 1) body or fabric from being caught in-between belt 1204 and any portion of an assembly frame 1206 (FIG. 12) as belt 1204 wraps around roller 1302 or 1304. In one example, wiper 1902 comprises polycarbonate or TEFLON®, a registered trademark of DuPont®.

Figure 20:
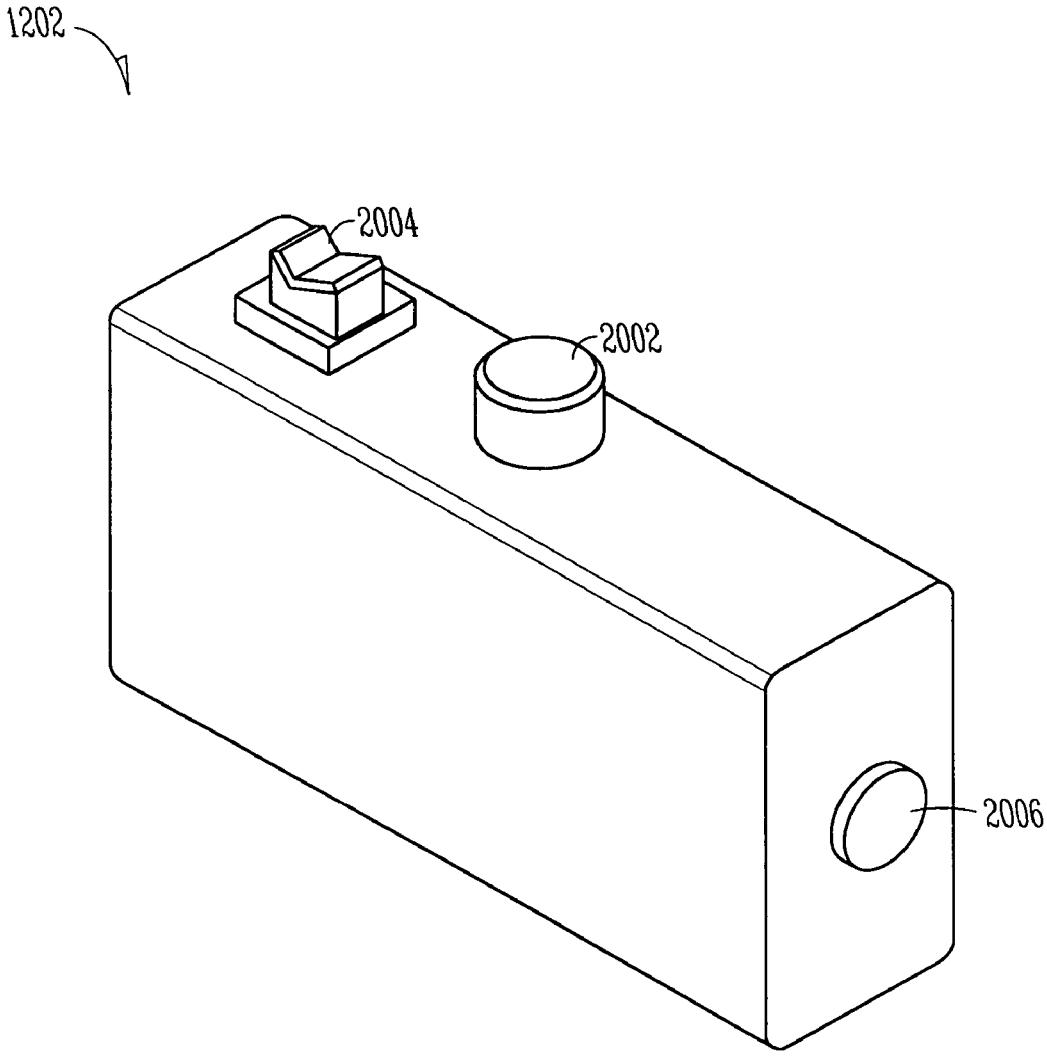
FIG. 20 is an isometric view illustrating an input device of a conveyor assembly, as constructed in accordance with at least one embodiment.

FIG. 20 is an isometric view of an input device 1202 of a conveyor assembly 202 (FIG. 12). In this example, input device 1202 comprises an on/off power button 2002, a forward/reverse switch 2004, and a charging port 2006 for receiving electricity for recharging a power source 1402 (e.g., rechargeable batteries). In addition, input device 1202 may include a light indicator (not shown) representing a power source 1402 remaining charge.

Figure 21:
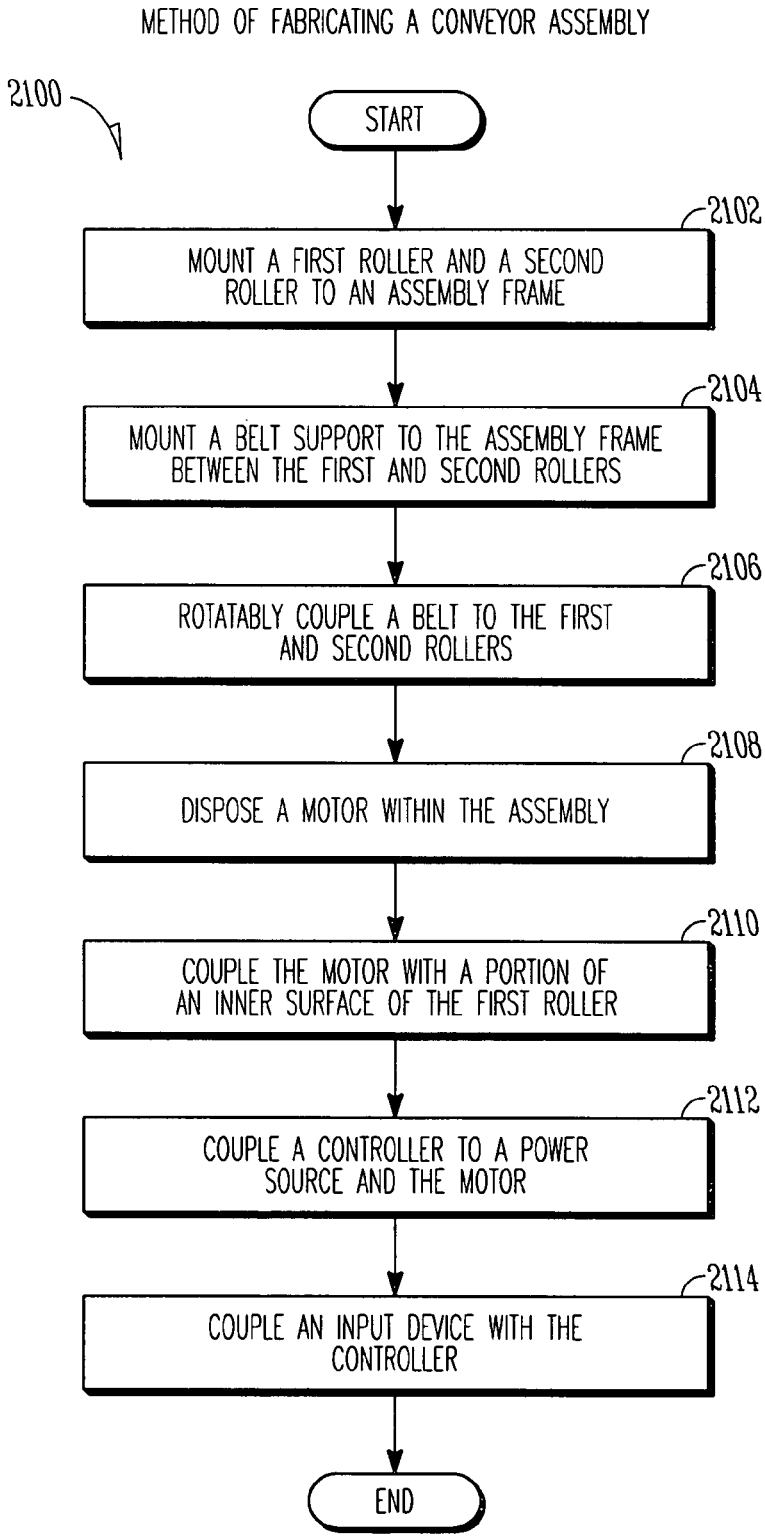
FIG. 21 is a flow diagram illustrating a method of fabricating a conveyor assembly, as constructed in accordance with at least one embodiment.

FIG. 21 is flow diagram illustrating a method of fabricating a portable conveyor assembly. At 2102, a first roller and a second roller spaced apart from the first roller are mounted to an assembly frame. In one example, the rollers are rotatably mounted at their respective ends to assembly frame ends. At 2104, a substantially flat belt support is mounted to the assembly frame between the first and second rollers. In one example, the belt support includes a polymer (such as TEFLON®) or other material having a low coefficient of friction, such as about 0.35 or less, with an underside surface of a belt rotatably coupled to a portion of the first and second rollers, at 2106. The polymer or other material may be attached to the belt support using a high bond adhesive such as VHB®, available from 3M Company, of St. Paul, Minn., USA. The belt is coupled to the rollers in such a matter that the assembly frame is positioned, at least in part, between the rollers and surrounded by the belt. The belt is oriented to rotate perpendicular to a length of the assembly.

At 2108, a motor is disposed within the assembly (e.g., in an area enclosed by the assembly frame and the first and second rollers). At 2110, the motor is coupled to the belt via the first or second rollers. In one example, the motor is coupled with an inner surface portion of the first roller, which is rotatably coupled to the belt. In another example, the belt is rotatably coupled to the first or second rollers by way of tension or via matable teeth and teeth receiving portions formed on an outer surface of the rollers and the underside of the belt, respectively. At 2112, a controller is coupled to a power source and the motor. Alternatively, a pulse width modulator coupled with a potentiometer may be used in lieu of the controller. At 2114, an input device adapted to receive command instructions, among other things, from a user is coupled with the controller (via a cable or wirelessly).

Several options for fabricating a conveyor assembly are possible. In one example, the fabrication includes disposing the power source within the assembly, such as in an area enclosed by the frame ends and the first and second rollers or within a lumen of one of the rollers. In another example, the fabrication includes integrating at least one belt tension or alignment device with the assembly frame ends. In yet another example, the fabrication includes fastening one or more end covers to the frame ends.

CONCLUSION

The present assemblies and methods provide a safe, simple, and effective means of transferring subjects from one support surface to another while improving efficiency by being quicker and easier (than currently used assemblies and methods) to retrieve, use, and store after use. Specifically, the present assemblies and methods move a subject without lifting or sliding the subject and with a minimal amount of patient handling, thereby maintaining subject comfort and reducing the potential for worker injury. Although the present assemblies and methods have been discussed for utilization with human subjects, such assemblies and methods are not so limited. It will be appreciated by those skilled in the art that the present assemblies and methods may be utilized for the transfer of other non-human subjects as well. In addition, while a number of specific dimensions or method orders are discussed above, the conveyor assembly can be made of any size, length or width and may be used or fabricated in method orders other than those discussed. For example, the conveyor assembly could be made longer to support the entire subject including his/her head and legs.

Advantageously, the present assemblies and methods include many other desirable characteristics not found in the prior art including being adapted for use with conventional support surfaces and having a lightweight and compact design (thereby allowing for easy storage/transport). In addition, the present assemblies allow for the moving of various-sized subjects in a minimal amount of time (e.g., due to the assembly's 2× traverse design), even over unequal support surface heights.

It is to be understood that the above description is intended to be illustrative, and not restrictive. For example, the above detailed description may be used in combination with each other. Many other embodiments will be apparent to those of skill in the art upon reading and understanding the above description. The scope of the invention should, therefore, be determined with reference to the appended claims, along with the full scope of legal equivalents to which such claims are entitled. In the appended claims, the term "including" is used as the plain-English equivalent of the term "comprising." Also, in the following claims, the terms "including" and "comprising" are open-ended, that is, a system, assembly, device, or method that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract of the disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing detailed description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the detailed description, with each claim standing on its own as a separate embodiment.

What is claimed is:

1. A portable assembly for transferring a subject from a first support surface to an second support surface, the assembly comprising:

a first roller;

a second roller parallel with, and spaced apart from, the first roller;

an assembly frame longitudinally extending from a frame first end, positioned adjacent a first end of the first and second rollers, to a frame second end, positioned adjacent a second end of the first and second rollers, the frame ends supporting and suspending the first and the second rollers through the longitudinal dimension therebetween;

a substantially flat belt support coupled to the assembly frame between the first and the second rollers, the belt support including an upper support surface and a lower support surface;

a continuous belt comprising a belt underside surface and a belt conveying surface, the belt underside surface mounted, in part, on an outer surface portion of the first and second rollers and extending outside both the upper and lower support surfaces of the belt support, the belt conveying surface contacting the subject and the first and second support surfaces during a transfer process;

a motor coupled to the belt; and a power source, coupled to the motor.

2. The assembly as recited in claim 1, wherein the first roller comprises a drive roller and the second roller comprises an idle roller.

3. The assembly as recited in claim 2, wherein a diameter of the drive roller is greater than a diameter of the idle roller.

4. The assembly as recited in claim 3, wherein a width of the assembly frame extends from an assembly leading travel side to an assembly trailing travel side, the trailing side shaped narrower than the leading side.

5. The assembly as recited in claim 1, wherein the first roller is motor driven at one or both first roller ends.

6. The assembly as recited in claim 1, wherein the motor is disposed within a first roller lumen and coupled with an inner surface portion of the first roller.

7. The assembly as recited in claim 1, wherein an outer surface of one or both of the first roller or the second roller include at least one belt driving projection matable with at least one projection receiving portion disposed on the belt underside surface.

8. The assembly as recited in claim 1, wherein the upper support surface and the lower support surface comprise a polymer material having a coefficient of friction with the belt underside surface of about 0.35 or less.

9. The assembly as recited in claim 1, wherein the power source comprises a rechargeable battery disposed in an enclosed area between the first and second frame ends and the first and second rollers.

10. The assembly as recited in claim 1, wherein the belt is configured to rotate in a direction perpendicular to the longitudinal extension of the assembly frame.

11. The assembly as recited in claim 1, wherein the power source comprises a connection to a power cord.

12. The assembly as recited in claim 1, comprising one or more belt tension or alignment devices integrated with the first or the second frame ends.

13. The assembly as recited in claim 1, comprising a controller coupled to the power source and the motor.

14. The assembly as recited in claim 13, comprising an input device communicable with the controller, the input device adapted to receive and transmit user-generated command instructions.

15. The assembly as recited in claim 1, comprising a pulse width modulator coupled to the power source, the motor, and an input device adapted to receive and transmit user-generated command instructions.

16. The assembly as recited in claim 1, comprising one or both of a head support member coupled to the frame first side or a leg support member coupled to the frame second side.

17. A portable conveyor assembly comprising:

a first roller;

a second roller spaced from the first roller;

an assembly frame extending from a frame first end to a frame second end, the frame ends supporting and suspending the first and the second rollers therebetween;

a single belt coupled to the first and second rollers in such a matter that an intermediate portion of the assembly frame is positioned between the rollers and surrounded by the single belt, such that that belt forms an upper portion and a bottom portion of the assembly when in operation; and a rotary motor powered by a power source, the motor coupled to a portion of the first or the second roller and providing roller rotation effectuating rotation of the belt in a direction perpendicular to a length of the assembly frame.

18. A portable conveyor assembly comprising:

a first roller;

a second roller spaced from the first roller;

an assembly frame having a width and a length supporting the first and the second rollers, the first and the second rollers separated by the width;

a belt coupled to the first and second rollers in such a matter that the assembly frame is positioned, at least in part, between the rollers and surrounded by the belt; and a rotary motor powered by a power source, the motor coupled to a portion of the first or the second roller;

wherein the motor is disposed within a first roller lumen and coupled with an inner surface portion of the first roller.

19. The assembly as recited in claim 17, wherein at least one of the first or the second roller comprise a drive roller.

20. The assembly as recited in claim 17, comprising a belt support disposed between the first and second rollers, the belt support including an upper portion and a lower portion; and wherein the upper or lower portion comprise a material having a coefficient of friction with a belt underside surface of about 0.35 or less.

21. The assembly as recited in claim 17, comprising a controller disposed between the first and second rollers and between the frame first and second ends, the controller coupled to the motor and the power source.

22. The assembly as recited in claim 21, comprising an input device communicatable with the controller, the input device including one or more of a power switch, a speed control, a direction control, a power source indicator, or a power source recharge connection.

23. The assembly as recited in claim 17, comprising one or more roller guard members disposed adjacent a belt leading or a belt trailing side.

24. The assembly as recited in claim 17, comprising at least one wiper surrounding, in part, one or both of the first or the second roller.

25. A portable assembly for transferring a subject from a first support surface to an second support surface, the assembly comprising:

a first roller;

a second roller parallel with, and spaced apart from, the first roller;

an assembly frame longitudinally extending from a frame first end to a frame second end, the frame ends supporting the first and the second rollers therebetween;

a substantially flat belt support coupled to the assembly frame between the first and the second rollers, the belt support including an upper support surface and a lower support surface;

a belt comprising a belt underside surface and a belt conveying surface, the underside surface mounted, in part, on an outer surface portion of the first and second rollers;

a motor coupled to the belt; and a power source, coupled to the motor;

wherein the power source comprises a rechargeable battery disposed in an enclosed area between the first and second frame ends and the first and second rollers and a removable power source cap adapted to allow for insertion and removal of the power source from within the enclosed area.

26. A method of fabricating a portable conveyor assembly, the method comprising:

mounting at least a first roller and a second roller spaced from the first roller to an assembly frame, the assembly frame extending from a frame first end to a frame second end, the frame ends supporting and suspending the first and the second rollers therebetween;

coupling a single belt to the first and second rollers in such a manner that an intermediate portion of the assembly frame is positioned between the rollers and surrounded by the single belt, such that the belt forms an upper portion and a bottom portion of the assembly when in operation, including orientating the belt to rotate perpendicular to a length of the assembly;

disposing a motor within the assembly; and coupling the motor to the belt.

27. The method as recited in claim 26, wherein coupling the motor to the belt includes coupling the motor with an inner surface portion of the first roller rotatably coupled to the belt.

28. The method as recited in claim 26, comprising mounting a substantially flat belt support to the assembly frame between the first and the second rollers.

29. The method as recited in claim 26, comprising forming one or more belt driving projections on an outer surface of the first roller and forming one or more projection receiving portions on a belt underside surface.

30. The method as recited in claim 26, comprising disposing a power source within the assembly.

31. The method as recited in claim 26, comprising integrating at least one belt tension or alignment device with a first or a second assembly frame ends.

32. The method as recited in claim 26, comprising coupling a controller or a pulse width modulator to a power source and the motor, and communicatively coupling an input device with the controller or the pulse width modulator.

33. A method of horizontally transferring a subject from a first support surface to a second support surface, the method comprising:

inserting a portable, motor-driven conveyor assembly, having a width and having a length, between the subject and the first support surface, the conveyor assembly comprising an assembly frame longitudinally extending from a frame first end to a frame second end, the frame ends supporting and suspending the first and the second rollers therebetween; and transferring the subject to the second support surface using a belt rotating in a direction perpendicular to the length of the conveyor assembly;

wherein inserting the portable conveyor assembly between the subject and the first support surface includes, rolling the subject onto his/her side such that the subject is facing away from the second support surface;

placing the portable conveyor assembly longitudinally adjacent the subject; and rolling the subject on his/her back onto the portable conveyor assembly.

34. The method as recited in claim 33, wherein placing the portable conveyor assembly adjacent the subject includes wedging a narrowly-shaped assembly trailing side between the subject and the first support surface.

35. The method as recited in claim 33, wherein transferring the subject includes:

actuating the portable conveyor assembly toward the second support surface;

supporting the subject's head and legs; and stopping the portable conveyor assembly upon reaching an end of travel of the assembly.

36. The method as recited in claim 33, wherein transferring the subject includes conveying the subject at approximately twice the distance traversed by the assembly.

37. The method as recited in claim 33, comprising rolling the subject onto his/her side once the subject has reached a desired location on the second support surface, such that the subject is facing away from the first support surface.

38. The method as recited in claim 33, comprising removing the portable conveyor assembly, and rolling the subject over onto his/her back on the second support surface.

39. The method as recited in claim 38, wherein removing the portable conveyor assembly includes actuating or lifting the assembly away from the subject.

* * * * *

UNITED STATES PATENT AND TRADEMARK OFFICE

CERTIFICATE OF CORRECTION

PATENT NO. : 7,540,043 B2
APPLICATION NO. : 11/293884
DATED : June 2, 2009
INVENTOR(S) : Stackley et al.

It is certified that error appears in the above-identified patent and that said Letters Patent is hereby corrected as shown below:

On the Title page, in field (57), under "Abstract", in column 2, line 7, delete "matter" and insert -- manner --, therefor.

In column 3, line 2, delete "therefore" and insert -- therefor --, therefor.

In column 8, line 39, after "rely" insert -- on --.

In column 11, line 40, delete "matter" and insert -- manner --, therefor.

In column 14, line 20, in Claim 17, delete "matter" and insert -- manner --, therefor.

In column 14, line 22, in Claim 17, after "that" delete "that".

In column 14, line 36, in Claim 18, delete "matter" and insert -- manner --, therefor.

In column 14, line 58, in Claim 22, delete "communicatable" and insert -- communicable --, therefor.

Signed and Sealed this

Eighteenth Day of August, 2009

David J. Kappos

David J. Kappos
*Director of the United States Patent and Trademark Office*